US008037917B2

(12) United States Patent
Steele et al.

(10) Patent No.: US 8,037,917 B2
(45) Date of Patent: Oct. 18, 2011

(54) SHIPPING AND PACKING TAPE DISPENSER AND MOUNT

(75) Inventors: Richard W. Steele, Traverse City, MI (US); Wendy H. Steele, Traverse City, MI (US)

(73) Assignee: Stexley-Brake, LLC, Traverse City, MI (US)

( * ) Notice: Subject to any disclaimer, the term of this patent is extended or adjusted under 35 U.S.C. 154(b) by 698 days.

(21) Appl. No.: 12/113,641

(22) Filed: May 1, 2008

(65) Prior Publication Data

US 2008/0271853 A1 Nov. 6, 2008

Related U.S. Application Data

(60) Provisional application No. 60/915,986, filed on May 4, 2007, provisional application No. 60/974,934, filed on Sep. 25, 2007, provisional application No. 61/030,382, filed on Feb. 21, 2008.

(51) Int. Cl.
*B65H 35/07* (2006.01)

(52) U.S. Cl. ..... 156/523; 156/577; 156/579

(58) Field of Classification Search ..... 156/574, 156/577, 579, 523, 527
See application file for complete search history.

(56) References Cited

U.S. PATENT DOCUMENTS

| | | | | |
|---|---|---|---|---|
| 2,727,646 | A * | 12/1955 | David | 156/523 |
| 3,745,086 | A * | 7/1973 | Parker | 156/527 |
| 3,880,701 | A * | 4/1975 | Moree | 156/526 |
| 4,780,172 | A | 10/1988 | Shea | |
| 4,846,924 | A * | 7/1989 | Morrison | 156/384 |
| 5,110,401 | A | 5/1992 | Huang | |
| 5,197,386 | A * | 3/1993 | Lin | 101/213 |
| 5,267,703 | A | 12/1993 | Biagiotti | |
| 5,288,362 | A * | 2/1994 | Shuh-Chin | 156/523 |
| 5,384,003 | A | 1/1995 | Mitchell | |
| 5,468,332 | A | 11/1995 | Dretzka et al. | |
| 5,820,005 | A | 10/1998 | Perkitny et al. | |
| 5,849,144 | A | 12/1998 | Tang et al. | |
| 5,906,705 | A | 5/1999 | Chung et al. | |
| 6,634,402 | B2 | 10/2003 | Chen | |
| 6,651,718 | B2 | 11/2003 | Hua | |
| 6,695,190 | B1 | 2/2004 | Gunter | |
| 6,719,180 | B2 | 4/2004 | Shah | |
| 6,874,554 | B2 | 4/2005 | Chandaria | |
| 7,195,048 | B2 | 3/2007 | Wojtkun et al. | |
| 7,207,368 | B1 | 4/2007 | Lyman, Jr. | |
| 2005/0199345 | A1 * | 9/2005 | Yu | 156/527 |
| 2006/0169709 | A1 | 8/2006 | Bailey et al. | |
| 2007/0210204 | A1 | 9/2007 | Tang | |
| 2007/0210205 | A1 | 9/2007 | Tang | |
| 2008/0135181 | A1 * | 6/2008 | Lee | 156/530 |

FOREIGN PATENT DOCUMENTS

| | | | |
|---|---|---|---|
| JP | 2003054826 | A | 2/2003 |
| KR | 200295883 | Y1 | 11/2002 |
| KR | 1050050011644 | A | 1/2005 |

* cited by examiner

*Primary Examiner* — Mark A Osele
(74) *Attorney, Agent, or Firm* — McGarry Bair PC

(57) ABSTRACT

A shipping and packing tape type dispenser having a handle and a dispenser body for mounting a roll of tape for one-handed application to work surfaces. The dispenser includes a retractable press plate, tape retainer, spool anti-reverse and rotation-tensioning mechanism and exterior rails. A storage bracket has supports for mounting the dispenser through the exterior rails for a one-handed dispensing mode, a quick storage mode, and a more-secure quick storage mode. The handle has storage for pens, box-cutters, replacement cutting blades, a retractable tape measure and/or a retractable weigh scale. A cutting blade is frictionally mounted in an open-ended slot through a sidewall portion of the dispenser.

10 Claims, 34 Drawing Sheets

SHIPPING AND PACKING TAPE DISPENSER AND MOUNT

CROSS-REFERENCE TO RELATED APPLICATIONS

This application claims priority to U.S. Provisional Patent Applications Ser. Nos. 60/915,986, filed May 4, 2007, 60/974,934, filed Sep. 25, 2007, and 61/030,382, filed Feb. 21, 2008, all of which are incorporated herein by reference.

BACKGROUND OF THE INVENTION

1. Field of the Invention

The invention relates to shipping and packing tape dispensers with a generally vertical or "pistol" type grip, used to apply sealing tape to shipping cartons and similar containers using only one hand. In one of its aspects, the invention relates to a shipping and packing tape dispenser and mounting bracket combination that can mount the shipping and packing tape dispenser to a wall, to a post or under a counter. In another of its aspects, the invention relates to a shipping and packing tape dispenser and mounting bracket combination that mounts the shipping and packing tape dispenser for easy access, more permanent and secure storage and for dispensing shipping and packing tape. In yet another of its aspects, the invention relates to a shipping and packing tape dispenser that has a very simple, yet effective tape tensioner. In another of its aspects, the invention relates to a shipping and packing tape dispenser that has an integrated built in marker, knife, and/or spare blade storage. In another of its aspects, the invention relates to a shipping and packing tape dispenser that has an integrated measuring tape for measuring the size of shipping packages. In another of its aspects, the invention relates to a shipping and packing tape dispenser that has a quick feed and tape retainer that captures the free end of the tape after cutting for easy access for subsequent use. In another of its aspects, the invention relates to a shipping and packing tape dispenser that can be used for single piece tape dispensing or for application of tape to a package. In another of its aspects, the invention relates to a shipping and packing tape dispenser that has a cutting blade mounting that is secure and precisely formed by molded parts without mounting screws. In another of its aspects, the invention relates to a shipping and packing tape dispenser that has a cutting blade mounting that has a side mounting for easy installation and removal of blades from the cutting blade mounting. In another of its aspects, the invention relates to a shipping and packing tape dispenser that has an integrated scale for weighing packages for shipping. In another of its aspects, the invention relates to a shipping and packing tape dispenser in combination with a shipping station assembly that facilitates the use of the shipping and packing tape dispenser as well as other functions associated with packaging goods for shipping.

2. Description of Related Art

Businesses that ship a large number of packages and products by mail, courier, and freight delivery often use specialized tape dispensers, designed for sealing boxes with shipping tape using only one hand. An example of one such dispenser is illustrated generally at 10 in FIG. 1. These shipping tape dispensers typically have a vertical, pistol-type grip 12 supporting a frame 14 that houses a roll of tape 16. The frame includes a spool 18 for rotationally supporting the tape 16 on the frame, a hinged loading gate 20, a roller 22, a cutting bar 24 with a metal blade 26, and a press plate 28. The leading end 16*a* of the tape 16 is fed through the loading gate 20, which is then closed to hold the tape's non-sticky side against the roller 22.

Applying the sticky, outward-facing leading end 16*a* of the tape 16 to a package (not shown) and then drawing the dispenser 10 across the package using handle 12 pulls tape out of the dispenser and applies it neatly to the package in known manner. To cut the tape, the user cocks the dispenser 10 via the grip so that the cutting blade 26 and press plate 28 are both in contact with the tape. The press plate 28 effectively locks the tape down against the package to prevent further movement around roller 22, while cutting blade 26 severs the tape.

A common problem with prior shipping tape dispensers such as the type shown in FIG. 1 is that the leading end 16*a* of the cut tape curls over, sticky side down, onto the loading gate 20 or handle 12 after it has been cut. This makes it difficult for the person using the dispenser to quickly tape another part of the package or a different package.

Another problem with prior shipping tape dispensers such as 10 is that the cutting blade 26 projects beyond the cutting support bar 24, leaving a gap between the tape and the bar 24 such that the tape is unsupported between the roller and the blade and the tape may be cut prematurely.

Furthermore, at least one prior art tape dispenser is relatively heavy and is unbalanced, making it more difficult to maneuver.

Another problem with prior shipping tape dispensers such as 10 is the ability of tape 16 to rotate backward, pulling leading end 16*a* of the tape out of a convenient position near the roller. The prior art seems to have addressed this problem with a fairly complicated spring-tensioned hub for the spool (not shown, but known to those skilled in the art), which adjusts the force needed to rotate spool 18, but which adds cost and complexity to the dispenser and its use.

Another problem with prior shipping tape dispensers such as 10 is the tendency to misplace the dispenser, or to leave it out where sticky leading end 16*a* of the tape can attract debris or stick to things, or where the exposed cutting blade 26 can be a hazard.

Another problem with prior shipping dispensers such as dispenser 10, despite their ability to be used with one hand, is that packaging operations frequently require the use of package cutters, or marking pens, or measuring tapes, or scales, for which the dispenser must be put down while they are retrieved and/or used.

SUMMARY OF THE INVENTION

According to the invention, a gun-type shipping tape dispenser with a one-handed grip is provided with sets of tape guide tabs above and below the roller, eliminating the need for a hinged loading gate and positively preventing the cut end of the tape from curling back down to stick against the dispenser. In a preferred form, the upper set of tape guide tabs is beveled downwardly from their outer to their inner edges, and are mounted over a tape guide face between the roller and the cutting blade, with a gap between the guide face and the tabs so that the tape can be fed perpendicularly over the tabs onto the guide face, snapping into place under the guide tabs.

Further according to the invention, the tape dispenser has a fixed spool with an axially-removable portion for rotationally securing a roll of tape in the dispenser body. The spool has a smooth outer face on which the roll of tape rotates, the smooth outer face having one or more anti-reverse surfaces that frictionally prevent the roll of tape from rotating backward. In a first form, the anti-reverse surfaces take the form of flexible, cantilevered, ridged fingers or tabs that allow the roll of tape to rotate in a dispensing direction, but flex outwardly to rotationally lock the roll of tape against backward movement. In a preferred, second form, the outwardly-flexing tabs are formed on a larger, fixed portion of the spool assembly, with smooth outer ramp surfaces that are progressively cammed against the roll of tape by a removable hub portion of the spool assembly to adjustably tension the roll of tape on the spool assembly. A positive, rotating ratchet connection between the fixed spool and the hub allows the user to positively gauge the spool tension applied by the hub.

Still further according to the invention, a mounting bracket is provided for hand held shipping tape dispenser, in which the dispenser is loaded horizontally into the bracket while holding the grip with one hand. In a one embodiment, the bracket includes locking structure to secure the dispenser for one-handed tape dispensing from the bracket, and the dispenser has a retractable press plate for direct access of the tape from the roll, and to be fed out directly over the cutting blade, sticky side down, bypassing the roller and guide tabs. A retaining bar behind the blade holds the leading end of the cut tape. In a further form, the dispenser can be inserted in the bracket in a first position, blade-end first, for a quick-storage mode; and in a second postion for the locked mode, a third position for one-handed tape dispensing mode. In a further, preferred form of the invention, the bracket offers two levels of storage security for the dispenser in the quick-storage mode, one of which holds the dispenser more securely against vibration, useful for example when the bracket is mounted on a vehicle or warehouse forklift.

Still further according to the invention, the handle of a gun-type shipping tape dispenser is provided with an interior compartment for storing a packaging tool such as a box cutter or marking pen that can be pulled out with one hand. In a further embodiment, the handle compartment also includes a blade storage slot for one or more spare cutting blades.

Still further according to the invention, the handle or frame of a gun-type shipping dispenser is provided with a retractable measuring tape and/or a weigh scale hook that can be used while holding the dispenser handle. In one embodiment, the dispenser has an accessible interior compartment that can be loaded with a self-contained measuring tape or small digital scale, with the free end of the tape or scale fed through and captured in an external port or slot.

Still further according to the invention, the spool of a gun-type shipping tape dispenser is provided with a ring of intermittent, ramped shoulders around each side edge of the spool, at the junction with the spool sidewalls confining the tape, in order to decrease side-to-side play of the roll on the spool as tape is dispensed.

In one embodiment of the invention, the tape dispenser cutting blade is frictionally mounted in a transverse slot having a recessed opening through a sidewall portion of the dispensing end or "head" of the dispenser. The end of the blade is exposed for removal and replacement with a pair of common pliers. In a further form, the blade slot opening has a projection misaligned with the slot, so that the flexible metal blade is slightly bent during insertion into and removal from the slot. The blade returns to its relaxed, flat state when fully inserted, and the projection holds the blade more securely in the slot. Further, the blade can have double cutting edges in the sense that it has two cutting edges on the opposite edges of the blade, and the cutting edges can have different cutting blades for cutting different types of tape, such as packing tape and duct tape.

According to the invention, a tape dispenser for one-handed application and cutting of tape from a roll of tape comprises a handle grip, a frame mounted to the handle grip and having spool for mounting a roll of tape, a roller adjacent the spool for guiding a leading end of the tape from the spool, a guide face to guide the tape from the roller, a transverse cutting element adjacent the guide face for cutting the tape into segments and a press plate for pressing the tape onto an article and pressing the tape onto the transverse cutting element and at least one tape retainer extending partially over the guide face from a side thereof and spaced above the guide face to define a slot that is adapted to receive a first edge portion of a length of tape dispensed from the spool and over the roller onto the guide face. The first edge portion of the length of tape dispensed from the spool over the roller and onto the guide face can thereby be retained in the slot subsequent to cutting the length of tape by the transverse cutting element.

Preferably, the at least one tape retainer has a face that slopes downwardly and inwardly toward the guide face to facilitate movement of the tape edge into the slot when pressing the length of tape onto the guide face. In addition, there are two of the tape retainers that are positioned on opposite sides of the guide face.

Further according to the invention at least one lower guide tab extending partially over the roller from a side thereof and is spaced above the roller to define a slot that is adapted to receive a second edge portion of a length of tape dispensed from the spool and over the roller and thereby align the tape with the guide face when initially feeding the tape over the roller and to the guide face and to retain the second edge portion of the length of tape on the roller after the tape is cut by the transverse cutting element. In a preferred embodiment, there are two lower guide tabs that are positioned on opposite sides of the roller. Still further, the two lower tabs are spaced above the roller by a gap greater than a thickness of the tape so that the tape can be pulled over the roller when the tape is dispensed onto a package and to assist in feeding the tape to the guide face when initially feeding the tape from the roll of tape.

Typically, the at least one tape retainer is spaced above the guide face by a gap greater than a thickness of the tape so that the tape can be pulled across the guide face when the tape is dispensed onto a package.

Further, according to the invention, a tape dispenser for one-handed application and cutting of tape from a roll of tape comprises a handle grip, a frame mounted to the handle grip and having spool for mounting a roll of tape, a roller adjacent the spool for guiding a leading end of the tape from the spool, a guide face to guide the tape from the roller, a transverse cutting element adjacent the guide face for cutting the tape into segments and a press plate for pressing the tape onto an article and pressing the tape onto the transverse cutting element and at least one lower guide tab extending partially over the roller from a side thereof and spaced above the roller to define a slot that is adapted to receive an edge portion of a length of tape dispensed from the spool and over the roller and thereby align the tape with the guide face when initially feeding the tape over the roller and to the guide face and to retain the edge portion of the length of tape on the roller after the tape is cut by the transverse cutting element.

Preferably, there are two lower guide tabs that are positioned on opposite sides of the roller. Further, the two lower tabs are preferably spaced above the roller by a gap greater than a thickness of the tape so that the tape can be pulled over the roller when the tape is dispensed onto a package and to assist in feeding the tape to the guide face when initially feeding the tape from the roll of tape.

Still further according to the invention, a tape dispenser of the type having a dispenser body with a fixed spool for rotationally mounting a roll of tape on the dispenser body, and a cutting element spaced from the spool for cutting a leading end of tape dispensed from the spool has a cylindrical surface forming the spool on which a roll of tape is mounted for rotation about an axis of the spool. The spool has frictional resistance elements that frictionally contact an interior surface of the tape roll mounted on the spool to apply a frictional resistance to the tape roll when the tape roll rotates on the spool.

In one embodiment, the frictional resistance elements are configured to apply a differential frictional resistance to the tape roll when the tape roll rotates in different rotational directions. In addition, the frictional resistance elements can have directional ridges.

In another embodiment, the frictional resistance elements comprise flexible tabs that are integrally formed with the spool. In addition, a hub can be movably mounted to the spool and can have tensioning flanges that are in registry with the frictional resistance elements. In addition, interactive cam and cam follower elements on the tensioning flanges and the frictional resistance elements can adjust the radial position of the frictional resistance elements with respect to the spool as the hub moves with respect to the spool to thereby adjust the frictional resistance between the roll of tape on the spool as the roll of tape rotates on the spool.

In addition, indexing elements can be mounted to the spool and to the hub and in registry with each other to releasable retain the position of the hub on the spool in a plurality of adjusted relative positions. In one embodiment, the hub is rotatably mounted to the spool.

In one embodiment, complementary position indicators on the indexing elements provide a tactile, audible, and/or visible measure of the tension applied to the roll of tape by relative movement of the spool and hub.

Still further according to the invention, a tape dispenser of the type having a dispenser body with a fixed spool for rotationally mounting a roll of tape on the dispenser body, and a cutting element spaced from the spool for cutting a leading end of tape dispensed from the spool, a press plate for applying tape to a working surface and a gripping handle for one-handed application and cutting of tape from a roll of tape rotationally mounted on the tape dispensing body mounts the press plate in the dispenser body for movement between a first position for holding tape against the working surface prior to cutting the tape and a second position wherein the press plate is retractable substantially within the tape dispensing body to permit tape to be dispensed directly from the roll across the cutting element without contacting the press plate.

In one embodiment, the press plate is curved and rides in a curved track in the tape dispensing body. Further, the press plate has indentations in the edges thereof and the tape dispensing body has side walls with detents that are releasably received in the press plate indentations to selectively retain the press plate in the first and second positions.

In one embodiment the tape dispensing body has a front end that includes the cutting element for cutting tape dispensed by the tape dispensing body, a rear end, and sidewalls, the sidewalls having exterior rails protruding therefrom and a mounting bracket assembly has a pair of side walls rigidly joined together to form an open interior with an open front and open bottom, and at least one additional panel that is adapted to mount the bracket assembly to at least one of a post, an upright surface and the underside of a horizontal surface. The interior portions of the bracket sidewalls can have first supports that are adapted to mate with the exterior rails on the tape dispensing body sidewalls to support the tape dispenser in a tape dispensing position wherein the rear end of the tape dispensing body is within the bracket and the front end of the body faces outwardly for one-handed dispensing of the tape.

In another embodiment, the mounting bracket has a pair of generally vertical rails extending outwardly from a rear potion thereof. A shipping station organizer has an upright back wall and a laterally extending base, and the upright back wall has a pair or rails that are spaced and configured to slidably receive the mounting bracket generally vertical rails to mount the mounting bracket to the upright back wall of the shipping station organizer.

Still further according to the invention, a tape dispenser has a gripping handle and a tape dispensing body for one-handed application and cutting of tape from a roll of tape rotationally mounted on the tape dispensing body. The tape dispensing body has a front end that includes a cutting element for cutting tape dispensed by the tape dispensing body, a rear end, and sidewalls, the sidewalls having exterior rails protruding therefrom. A mounting bracket assembly has a rear wall, a top wall and side walls rigidly joined together to form an open interior with an open front and open bottom and at least one additional panel that is adapted to mount the bracket assembly to at least one of a post, an upright surface and the underside of a horizontal surface. The interior portions of the bracket sidewalls have first supports that are adapted to mate with the exterior rails on the tape dispensing body sidewalls to support the tape dispenser in a tape dispensing position when the rear end of the tape dispensing body is within the bracket and the front end of the body faces outwardly for one-handed dispensing of the tape. In addition, the interior portions of the bracket further have second supports that are adapted to mate with the exterior rails on the tape dispenser body sidewalls in a blade storage position wherein the front end of the tape dispensing body is within the bracket facing the rear wall and the rear end of the tape dispensing body faces outwardly to support the tape dispenser in a blade storage position.

In one embodiment, the first supports are configured to lock the tape dispenser horizontally and vertically in the support bracket in the one-handed dispensing position.

Further, the tape dispensing body comprises a press plate mounted in the side walls of the dispenser for movement between a first position for holding tape against a surface to which the tape is being applied prior to cutting the tape when the tape dispensing body is not mounted to the mounting bracket and a second position wherein the press plate is retractable substantially within the sidewalls of the tape dispensing body to permit tape to be dispensed directly from the roll across the cutting element without contacting the press plate when the tape dispensing body is mounted to the mounting bracket.

In addition, the interior portions of the bracket sidewalls can be further adapted to mate with the exterior rails on the tape dispensing body sidewalls in a second, more secure storage position when the front end of the tape dispensing body is inserted in the bracket.

The press plate can be curved and ride in a curved track in the tape dispensing body. In addition, the press plate can have indentations in the edges thereof and the side walls can have detents that are releasably received in the press plate indentations to selectively retain the press plate in the first and second positions.

In another embodiment, the mounting bracket has a pair of generally vertical rails extending outwardly of the side walls from the rear wall thereof. A shipping station organizer has an upright back wall and a laterally extending base, and the upright back wall has a pair or channels that are spaced and configured to slidably receive the mounting bracket generally vertical rails to mount the mounting bracket to the upright back wall of the shipping station organizer. Preferably, the channels converge slightly from the top to the bottom portion to firmly seat the mounting bracket rails in the channels. The shipping station organizer base can have a plurality of pockets for receiving marking pens and other tools for use with the tape dispenser. In addition, the shipping station back wall is adapted to be mounted to a vertical wall. Further, the shipping station base can be adapted to be mounted to a horizontal surface.

In another embodiment of the invention, a tape dispenser having a gripping handle and a tape dispensing body for one-handed application and cutting of tape from a roll of tape rotationally mounted on the dispenser has in the gripping handle a storage compartment that is adapted to frictionally and removably retain for one or more taping accessories selected from the group consisting of markers, spare blades, tools and pens.

Preferably, the gripping handle can have an opening in a bottom end thereof for access to the storage compartment. In addition, the gripping handle can have one or more integrally molded fingers that extend into the storage compartment of the gripping handle to releasably retain the taping accessories in the storage compartment.

In another embodiment of the invention, a tape dispenser having a gripping handle and a tape dispensing body for one-handed application and cutting of tape from a roll of tape rotationally mounted on the dispenser has a retractable measuring tape mounted inside the gripping handle or the inside tape dispenser body, wherein the measuring tape has a free end protruding from an opening in the gripping handle or tape dispensing body.

Preferably, the measuring tape can be mounted within the handle and the opening for the free end is in the handle.

In another embodiment of the invention, a tape dispenser having a gripping handle and a tape dispensing body for one-handed application and cutting of tape from a roll of tape rotationally mounted on the dispenser has a weigh scale mounted inside the dispenser. In one embodiment, the weigh scale has a weigh hook end protruding from an exterior portion of the dispenser adjacent the handle. In another embodiment, a plurality of load cells are mounted on one side wall of the dispenser and are adapted to detect the weight of an article positioned on the dispenser when the dispenser is positioned on a support surface. A display is operably connected to the load cells to display the weight of article so placed on the dispenser when the dispenser is positioned on a support surface. Typically, a circuit is connected to the load cells and the display for computing the weight of the article based on the inputs from the load cells.

In yet another embodiment of the invention, a tape dispenser of the type having a dispenser body with a fixed cylindrical spool face for rotationally mounting a roll of tape on the spool face, and a cutting element spaced from the cylindrical spool face for cutting a leading end of tape dispensed from the spool has sidewalls adjacent the cylindrical spool face that are adapted to axially trap the roll of tape on the spool face without hindering the rotation of the roll of tape. The spool face further comprising intermittent shoulders located at the junctions of the sidewalls with the spool face to reduce side-to-side movement of the roll of tape on the spool face as the roll of tape rotates and space the sides of the roll of tape from the spool side walls.

Preferably, the intermittent shoulders can have ramped or rounded surfaces. Further, the intermittent shoulders can be angled downwardly from the spool sidewalls toward the adjacent spool faces to support the interior circumference of the roll of tape without adding undue frictional resistance to the free rolling of the tape roll on the cylindrical spool face.

Still further according to the invention, a tape dispenser of the type having a dispenser body with a spool for rotationally mounting a roll of tape on the dispenser body, and a cutting element spaced from the spool for cutting a leading end of tape dispensed from the spool has as the cutting element an essentially flat blade frictionally mounted in a transverse slot that has an opening through a sidewall portion of the dispenser and an end of the blade extends from the transverse slot opening for removal access.

In one embodiment, a projection adjacent the transverse slot opening extends into the transverse slot opening to apply a blade-bending tension to the blade during insertion into and removal from the slot, and to secure the blade axially in the slot once the blade is fully inserted. In a preferred embodiment, the transverse slot opening is recessed into the sidewall.

In another embodiment, the blade has two opposite disposed cutting edges, each of which has a different cutting edge for cutting different types of tapes. One of the cutting edges can have coarse teeth that are adapted to cut packing tape and the other cutting edge can have finer teeth that are adapted to cut duct tape.

In another embodiment, the dispenser body can have a frame formed of an integrally formed main frame half and a cover frame half, the main frame half can include a transverse support and the cover frame can include a guide face, wherein when the main frame half and the cover frame are assemble together to form the dispenser body, the transverse support and the guide face are juxtaposed to each other and form between them the blade slot that receives and retains the blade in the dispenser body.

In yet another embodiment of the invention, a tape dispenser of the type having a dispenser body with a spool for rotationally mounting a roll of tape on the dispenser body, and a cutting element spaced from the spool for cutting a leading end of tape dispensed from the spool has as the cutting element an essentially flat blade frictionally mounted in a transverse slot and the blade has two opposite disposed cutting edges, each of which has a different cutting edge for cutting different types of tapes. One of the cutting edges can have coarse teeth that are adapted to cut packing tape and the other cutting edge can have finer teeth that are adapted to cut duct tape.

Still further according to the invention, a tape dispenser of the type having a dispenser body with a spool for rotationally mounting a roll of tape on the dispenser body, and a cutting element spaced from the spool for cutting a leading end of tape dispensed from the spool has a frame formed of an integrally formed main frame half and a cover frame half that are joined together for the body and a belt clip that is integrally molded into one of the main frame and the cover frame. In one embodiment, the belt clip is cantilevered out from an outer surface of the one of the main frame and the cover frame.

These and other features and advantages of the invention will become apparent from the detailed description below, in light of the accompanying drawings.

DETAILED DESCRIPTION OF THE DRAWINGS

Figure 1:
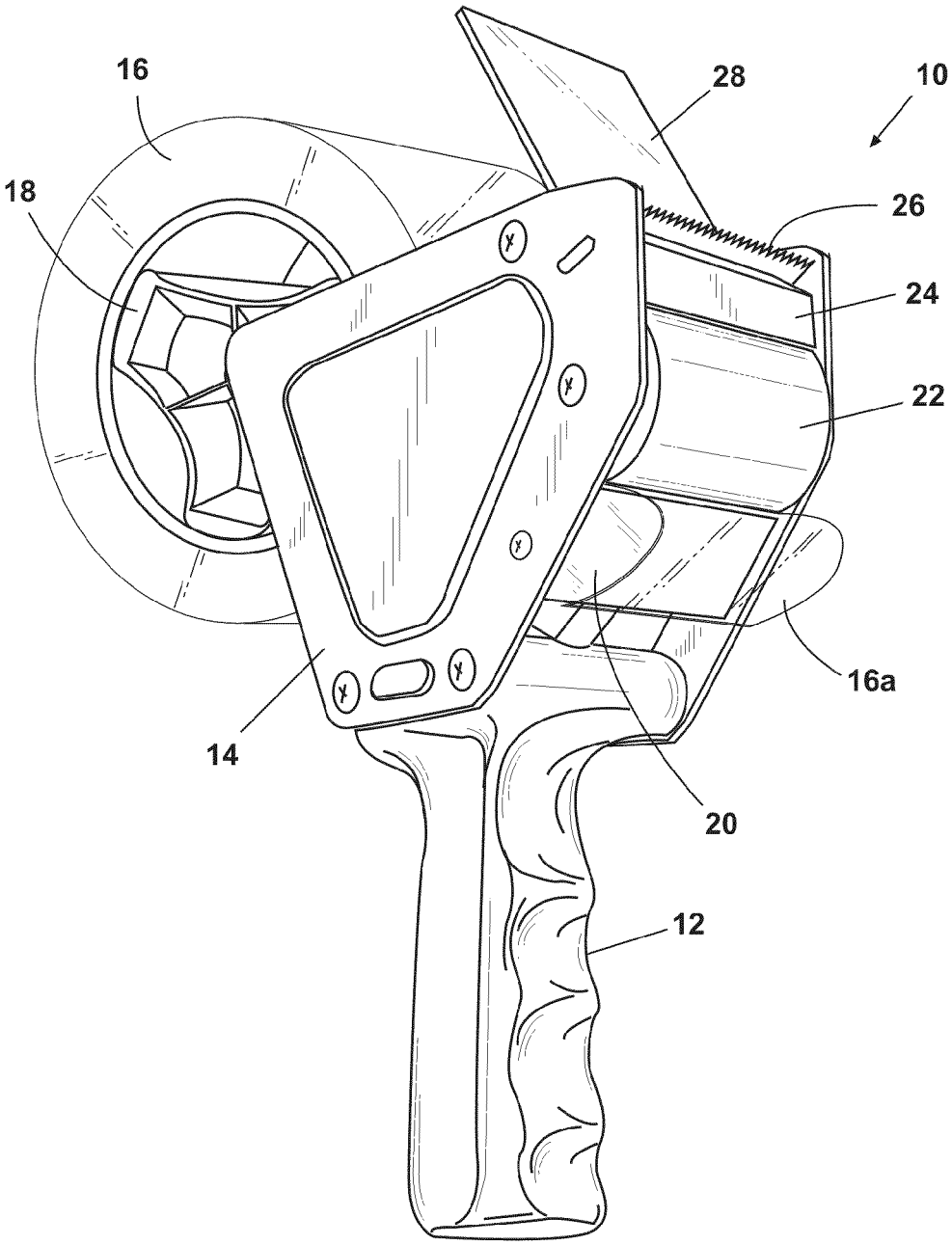
Fig. 1 (PRIOR ART)
FIG. 1 is a front perspective view of a prior art shipping tape dispenser.
Figure 2:
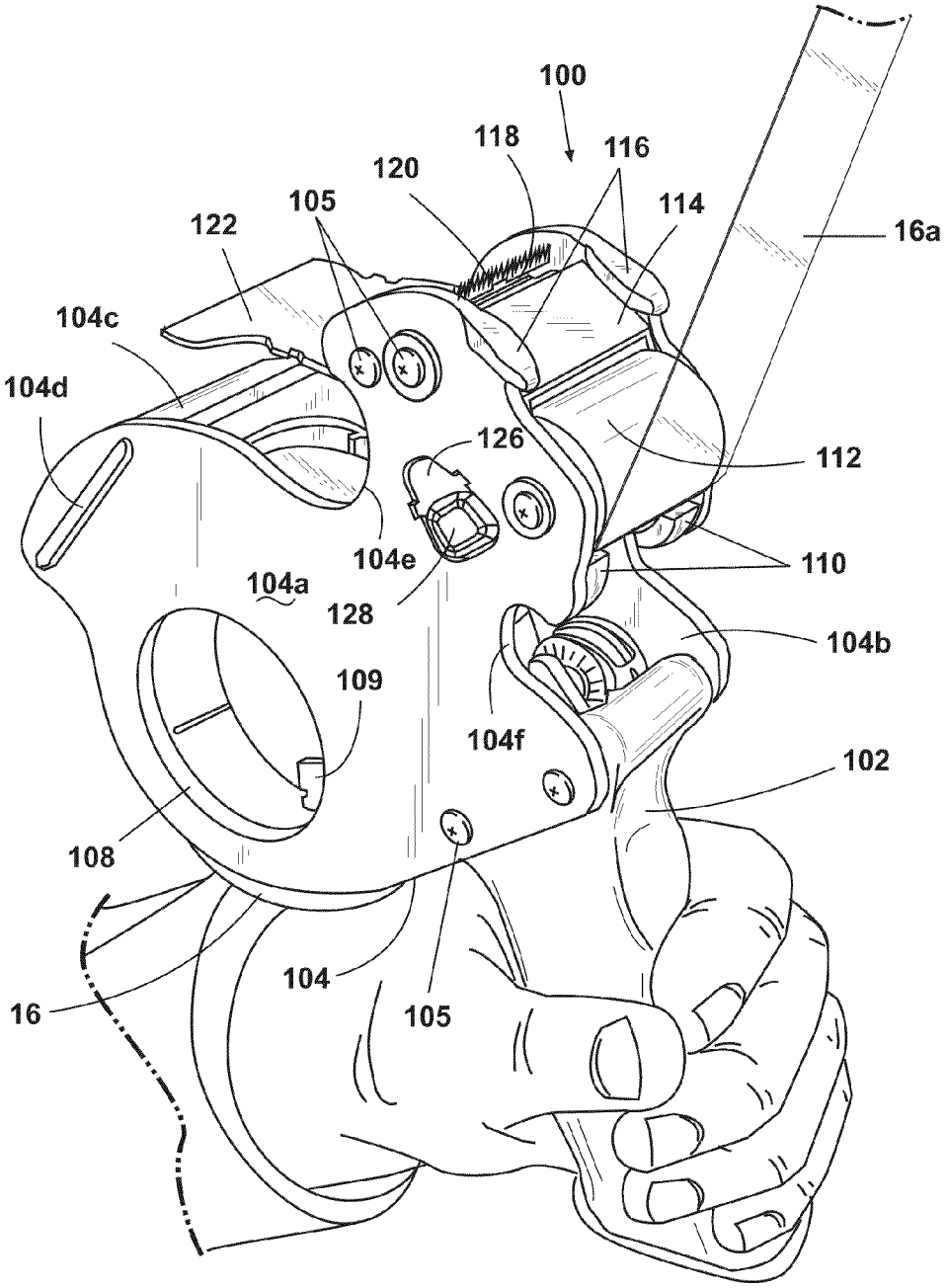
FIG. 2 is a front perspective view of a shipping tape dispenser according to the present invention, with tape being fed through a lower set of guide tabs.

Referring first to FIG. 2, a tape dispenser according to the present invention is shown generally at 100, operable with one hand to apply shipping tape 16 to a package or box. Although tape dispenser 100 will be referred to as a shipping tape dispenser for convenience, it will be understood that tape dispenser 100 could be used to apply other types of similar tape to items other than packages and boxes.

Tape dispenser 100 has a generally vertical pistol-type grip 102 connected to a tape dispensing body that includes a frame or housing 104 housing a roll of tape 16. Housing 104 in the illustrated embodiment includes a pair of spaced sidewalls 104*a* and 104*b* secured to each other with bolts or screws 105 in permanent or semi-permanent fashion, and a top wall or cover 104*c* secured between the sidewalls to space them. It will be understood that while the illustrated frame 104 is preferred, it can take other shapes and can be built or formed with different methods known to those skilled in the art. The major parts of dispenser 100 are preferably made from a durable plastic material, although other materials and combinations of materials can be used.

Figure 4:
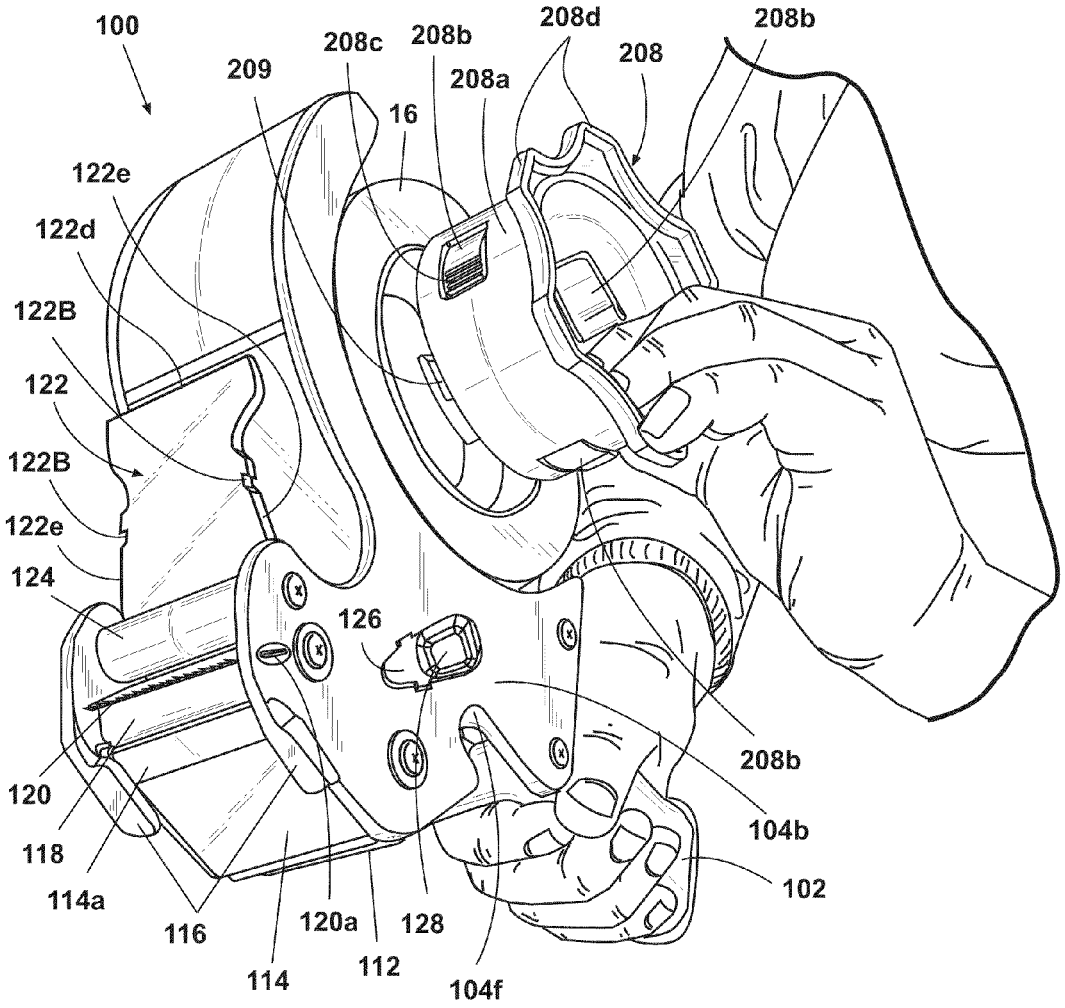
FIG. 4 is a front perspective view of the dispenser of FIG. 2, with an axially-removable spool portion shown removed from the dispenser body.
Figure 4A:
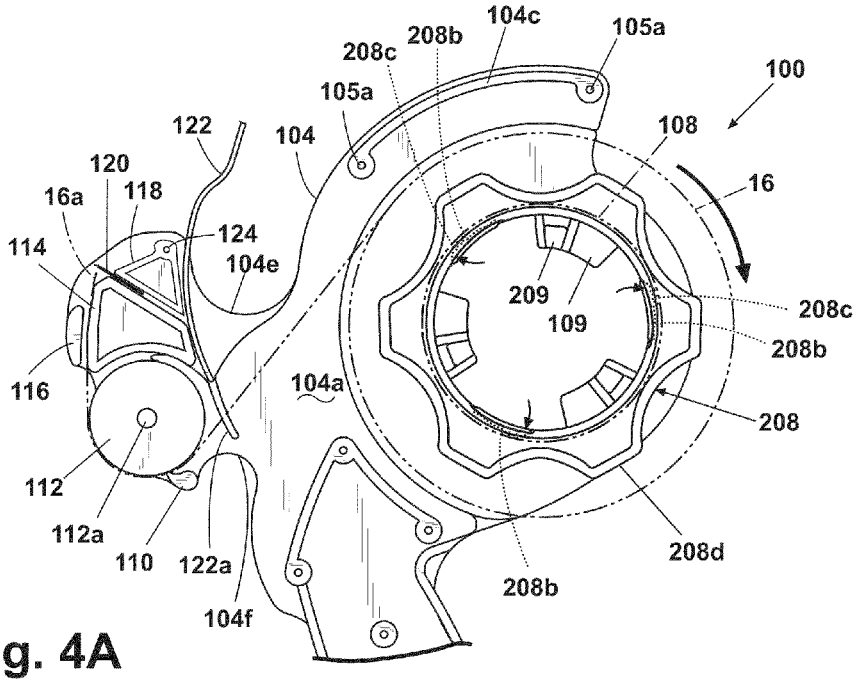
FIG. 4A is a side elevation view of the spool portion of FIG. 4 installed on the dispenser, showing in hidden lines a plurality of anti-reverse tabs preventing the roll of tape from rotating opposite the tape-feed/dispensing direction.
Figure 4B:
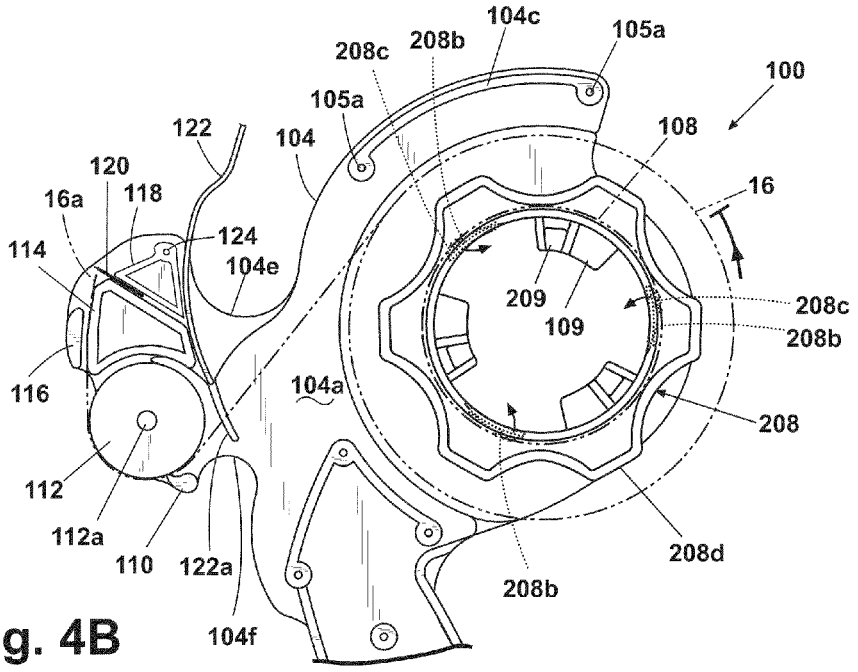
FIG. 4B is similar to FIG. 4A, showing the anti-reverse tabs flexing inwardly to allow the roll of tape to rotate freely on the spool in the dispensing direction.

A fixed, non-rotating spool 108 extends between the sidewalls 104*a-b* to rotatably support a roll of standard shipping tape 16, the spacing between the sidewalls being sufficient to let the tape roll freely on the spool. The tape will typically be on the order of two or three inches wide, but dispenser 100 can be built in different widths and sizes to accommodate different rolls of tape. FIG. 4 shows a preferred arrangement, in which the right-hand sidewall 104*b* is formed to expose the roll of tape 16, allowing the roll to be axially placed on and removed from spool 108, which extends as a molded piece from sidewall 104*a*. Spool 108 includes an axially removable "half" 208, in the illustrated embodiment having a smooth outer face 208*a* that mates seamlessly with a corresponding face on spool portion 108, one or more frictional resistance elements in the form of anti-reverse tabs 208*b* that apply a differential resistance to the roll of tape depending on the direction of rotation of the roll on the spool portion 108. In one embodiment, the frictional resistance elements can resist the roll of tape 16 from rotating backwards on the spool under normal conditions, and an outer edge or rim 208*d* that provides a convenient gripping surface and that can also be decorative. Spool portions 108 and 208 are preferably locked together with sets of rotationally mating L-shaped tabs 109 and 209, as disclosed in our co-pending U.S. application Ser. No. 11/532,515 (the relevant portion of which is incorporated herein by reference), although it will be understood by those skilled in the art that other types of rotational and/or axial locking connection could be used to mate the spool portions 108 and 208 through a roll of tape.

Referring to FIGS. 2, 2A-2B, and 3, the leading end 16*a* of tape 16 comes off the roll (sticky side down) and is fed beneath a set of lower tape guide tabs 110, over the surface of a roller 112, and across a guide face 114 through an upper set of guide tabs 116 located over face 114. The lower tape guide tabs 110 extend partially over the roller 112 from a side thereof and are spaced above the roller 112 to define a slot that is adapted to receive an edge portion of a length of tape dispensed from the tape roll and over the roller 112 and thereby retain the edge portion of the length of tape on the roller 112 after the tape is cut. The two lower tabs 110 are spaced above the roller 112 by a gap greater than a thickness of the tape so that the tape can be pulled over the roller when the tape is dispensed onto a package. As can be seen in the drawings, the two lower guide tabs are positioned on opposite sides of the roller 112. Although the preferred embodiment of the invention has two lower guide tabs 110 and directly across from each other, it is within the scope of the invention to use a single lower guide tab 110, or alternatively to use two guide tabs 110 that are on the opposite side of the guide face 114 but offset from each other across the guide roller 112 to retain the tape on the underlying tape guide face 114 subsequent to cutting the tape. The two lower guide tabs 110 also perform the function of aligning the tape 16*a* on the roller 112 so that it is in alignment with the guide face 114. For example, the end of the tape 16 is initially pulled from the tape roll and collapsed laterally into a rope or tail and drawn over the roller 112 toward the guide face 114. As the tape is pulled over the roller 112, it widens and the edges are guided into the slots between the roller 112 and the tape guide tabs 110. The tape 16*a* will then be in alignment with the guide face 144, the cutting element 120 and the press plate 122.

A transverse cutting element 120, in the illustrated embodiment a serrated metal blade of known type, is mounted in a slot in a transverse bar or support 118 between the sidewalls 104*a*-*b* above or "downstream" from tabs 116 a distance preferably equal to or less than the length of tabs 116. Blade 120 is preferably removably inserted and replaced through a slot 120*a* opening onto one of the side-plates 104*a*-*b* (FIG. 4) and is thus separably fixed in the housing 104, but other mounting arrangements are possible, and permanent blades or molded-in cutting surfaces are possible. In a preferred form, blade 120 is double-sided and can be reversed when one side gets dull. In addition, the blade 120 can have two different, oppositely disposed cutting edges, each one having a different cutting edge. For example, one cutting edge can have more coarse teeth that are adapted for cutting packing tape and the other cutting edge can have finer teeth that are adapted for cutting duct tape. The leading end 16*a* of the tape is accordingly held in place around roller 112 by the upper and lower sets of tabs 116 and 110, with the elongated upper tabs 116 ensuring that the leading end 16*a*, once cut, cannot curl back down onto the tape below tabs 116, or onto the handle 102. Relief areas 104*e* and 104*f* in the frame sidewalls provide good access to the leading end of the tape when it is initially stuck to the roll of tape.

Figure 2A:
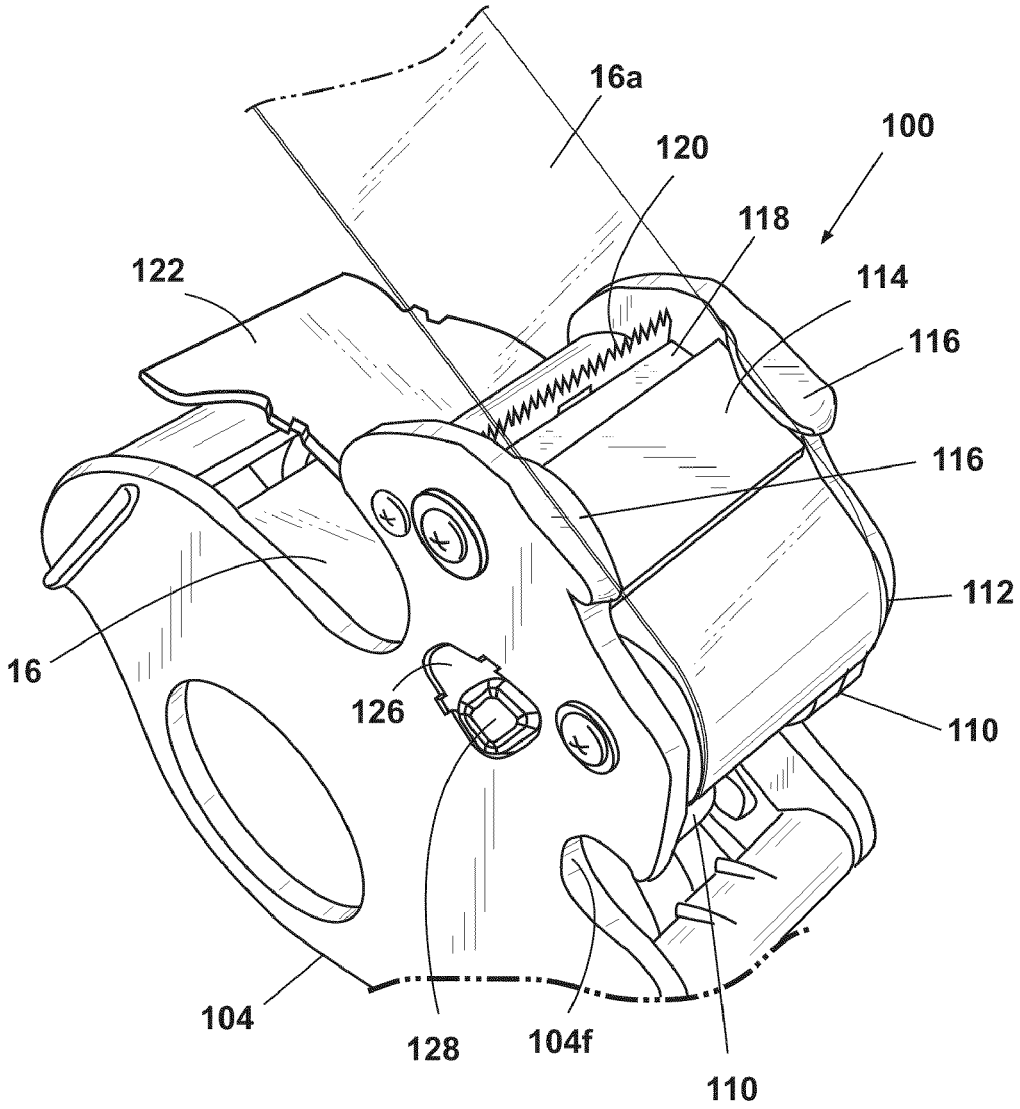
FIG. 2A shows the dispenser of FIG. 2, with the tape being pressed perpendicularly onto an upper set of guide tabs over a guide face.

Tape retainers 116 are spaced from the underlying tape guide face 114 a distance greater than the thickness of the tape, such that the tape can be pulled across the guide face 114 without sticking to the tabs, and such that the sticky side of the tape can adhere to the undersides of the guide tabs 116 between uses, and can be easily pulled free of the tabs when needed. Illustrated tabs 116 are beveled and slope downwardly from their outer edges near sidewalls 104*a*-*b* toward guide face 114, so that the back (non-sticky) side of the tape can be initially loaded perpendicularly onto the guide face 114 over the faces of tabs 116 rather than being longitudinally fed through the gap between the guide face and tabs. FIG. 2A shows the back side of tape 16 being pressed against the faces of tabs 116, which are spaced a distance less than the width of the tape 16 and the width of the guide face 114. The tape will tend to snap into place over the tabs onto the guide face, with an audible pop, where it remains securely. Although the preferred embodiment of the invention has two tape retainers 116 and directly across from each other, it is within the scope of the invention to use a single tape retainer 116, or alternatively to use two guide tabs 116 that are on the opposite side of the guide face 114 but off set from each other across the tape guide face 114 to retain the tape on the underlying tape guide face 114 subsequent to cutting the tape.

Figure 2B:
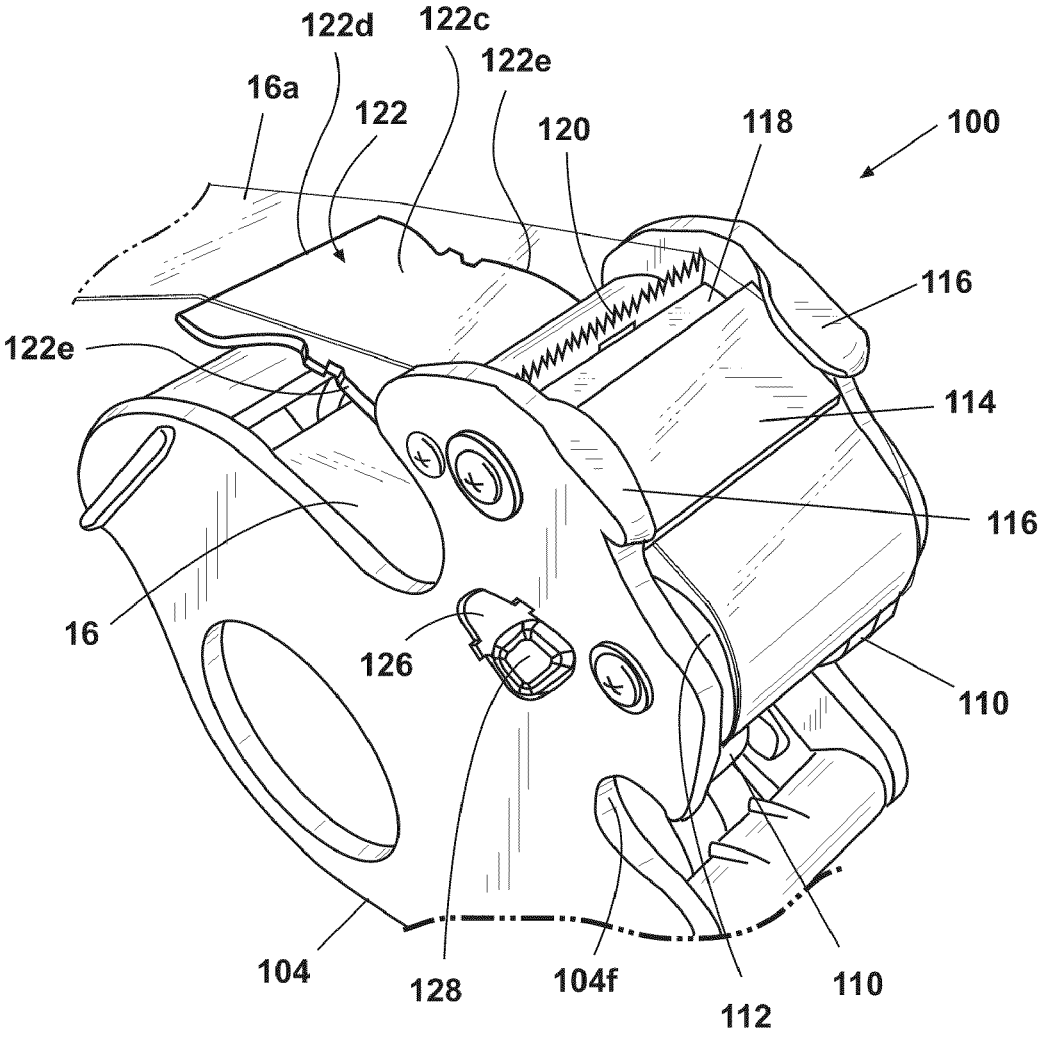
FIG. 2B shows the dispenser of FIG. 2, with the tape secured below the upper set of tabs on the guide face and tensioned by a press plate against the cutting blade.
Figure 3:
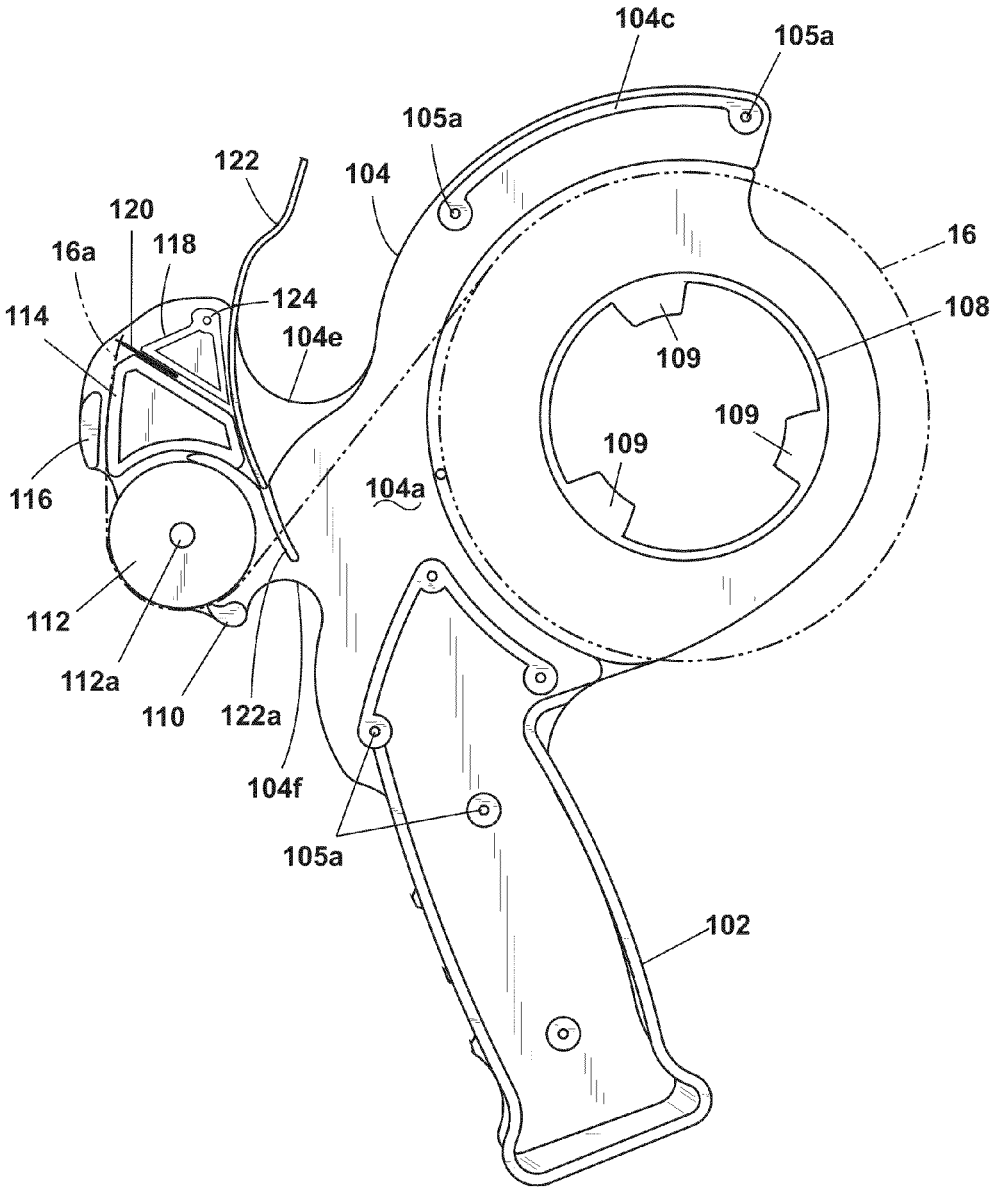
FIG. 3 is a side elevation view of a main half of the dispenser of FIG. 2, with a frame sidewall removed.

In use, the dispenser 100 is gripped with one hand as shown in FIG. 2, and the outward-facing sticky side of the tape 16 on roller 100 is placed against a package or box being taped. Dispenser 100 is then drawn across the box in known manner until the desired amount of tape has been applied, at which point the user cocks the dispenser 100 downwardly until both the blade 120 and the press plate 122 are in contact with the tape (FIG. 2B). The press plate 122 holds the leading end of the tape firmly against the box, locking it in place and tensioning it so that blade 120 can make a clean cut.

In use, the dispenser 100 is gripped with one hand as shown in FIG. 2, and the outward-facing sticky side of the tape 16 on roller 100 is placed against a package or box being taped. The press plate 122 has a planar pressing surface 122*c* bounded by an end edge 122*d* and side edges 122*e*. Dispenser 100 is then drawn across the box in known manner until the desired amount of tape has been applied, at which point the user cocks the dispenser 100 downwardly until both the blade 120 and the press plate 122 are in contact with the tape (FIG. 2B). The pressing surface 122*c* of the press plate 122 holds the leading end of the tape firmly against the box, locking it in place and tensioning it so that blade 120 can make a clean cut.

Press plate 122 is curved, and is retractably mounted in a curved slot 122*a*, for a purpose described below with reference to FIG. 5B. Notches 122*b* are provided in the upper and lower side edges 122*e* of press plate 122 and are selectively engaged by an integrally molded, flexible, cantilevered locking finger 126 located in each of the sidewalls 104*a*-*b* in order to selectively secure the press plate in its raised and retracted positions against the force of tape being cut or dispensed. The curved shape of press plate 122 and the curved retraction motion accommodate the adjacent roller 112. The locking fingers 126 have release buttons 128 at a lower portion, cantilevered detent portions 130 at an upper portion and a pair of hinge supports 132 at intermediate portions. The locking fingers 126 are resiliently mounted on the hinge supports 132 for pivotal movement about the hinge supports. Projections 134 on the inner sides of the cantilevered detent portions 130 are received in the notches 122*b* to releasably lock the press plate in extended and retracted positions. The press plate 122 is released by simultaneously pressing on the buttons 128 to retract the projections 134 from the notches 122*b*. The locking fingers 126 are biased to resiliently seat the projections 136 in the notches 122*b*. (See FIG. 15A.)

Figure 5:
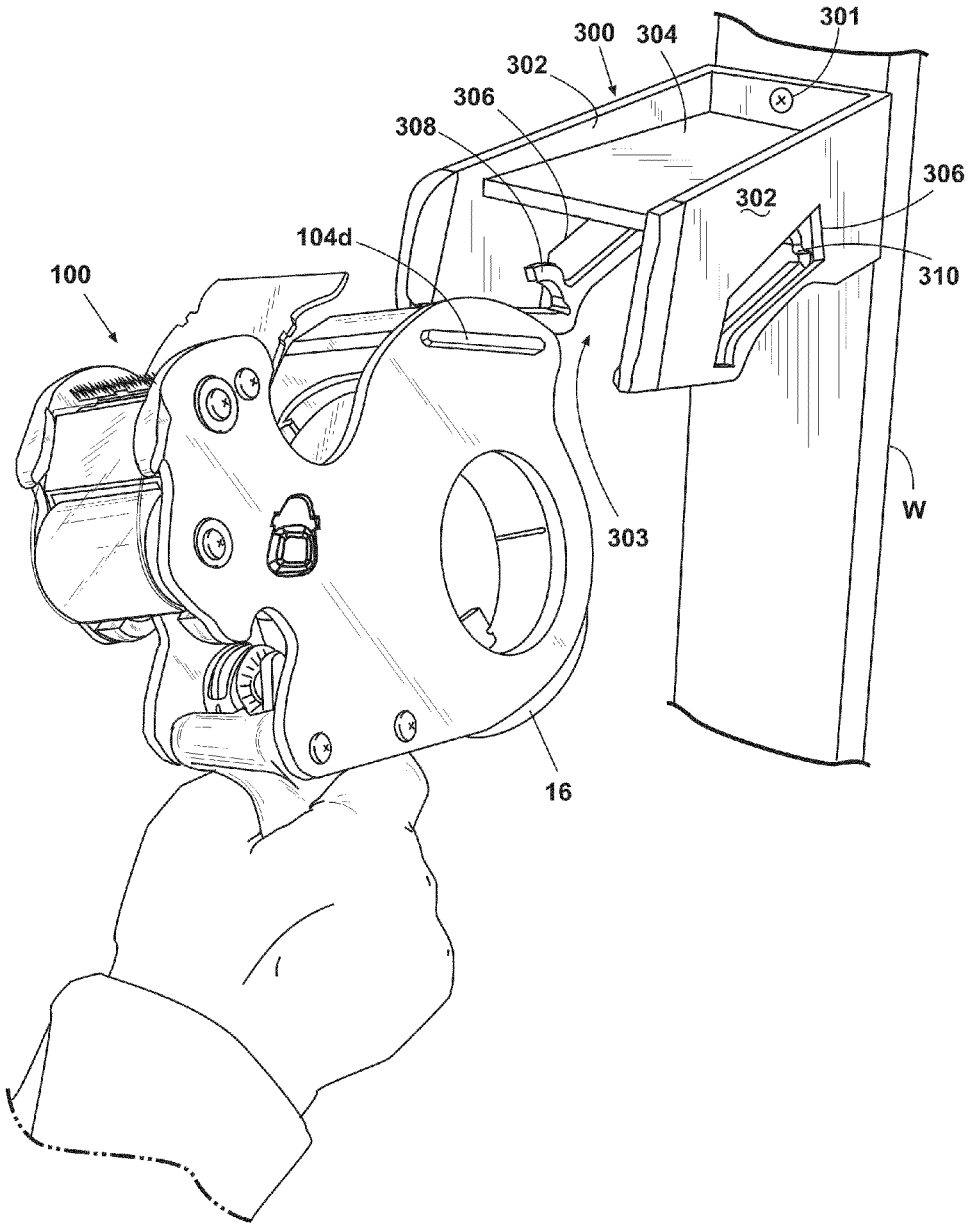
FIG. 5 is a perspective view of a wall-mounted storage bracket receiving the shipping tape dispenser of FIG. 2 in a one-handed dispensing mode.
Figure 5A:
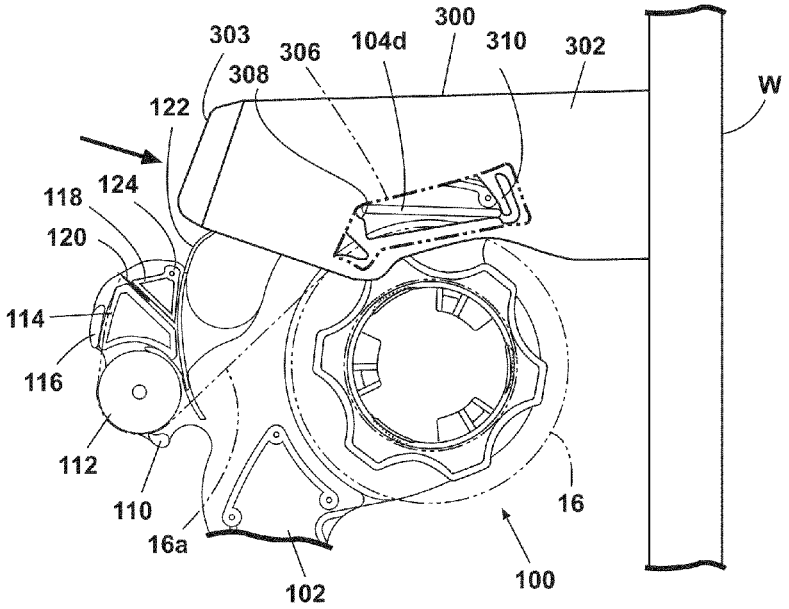
FIG. 5A is a side elevation view of the storage bracket of FIG. 5, with portions of the sidewall cut away to show interior locking structure engaging the shipping tape dispenser in a first condition.
Figure 5B:
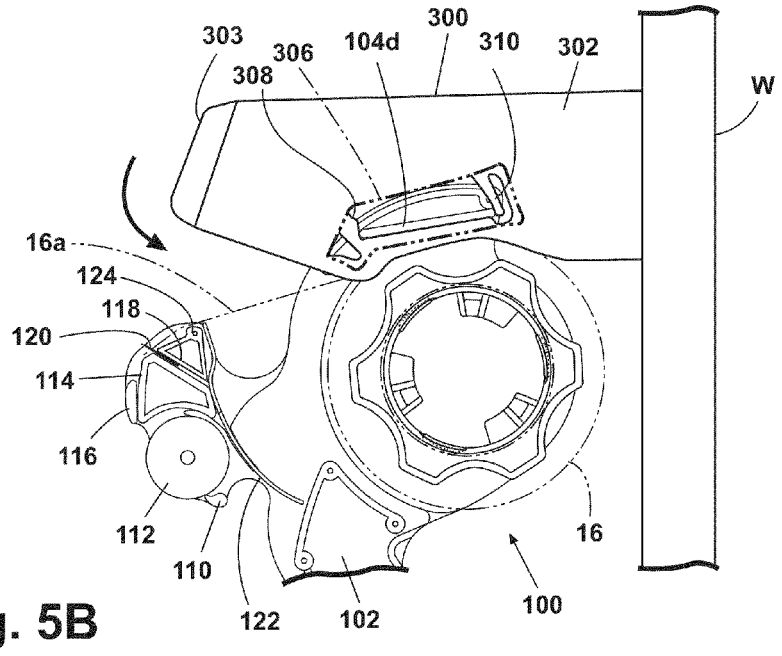
FIG. 5B is similar to FIG. 5A, but shows the interior locking structure engaging the shipping tape dispenser in a second, locked condition, and the dispenser modified for one-handed tape dispensing from the bracket mount.
Figure 7:
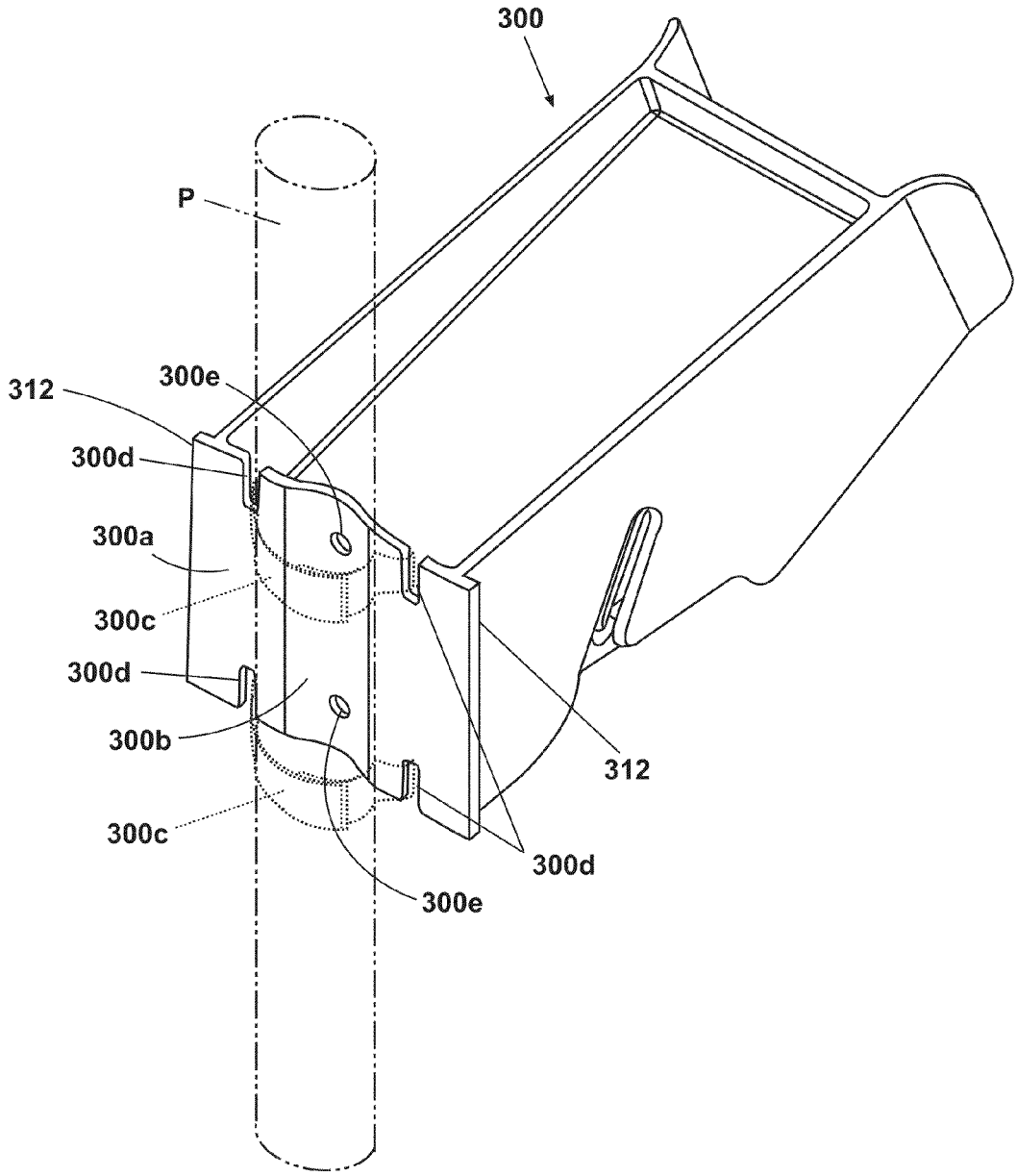
FIG. 7 is a perspective view of a rear face of a preferred version of the bracket of FIG. 5, in which the rear face is adapted to be mounted on a vertical post.

FIG. 5 shows a wall-mounted bracket 300 for storing dispenser 100 between uses, and also for dispensing tape one-handed from the bracket. Bracket 300 includes a pair of spaced sidewalls 302, a top wall 304, and locking slots 306 formed in the sidewalls. Bracket 300 can be mounted to a wall, for example with one or more screws 301 through an appropriate mounting hole in the bracket as illustrated, or through additional mounting holes through the top wall to be mounted to the underside of a shelf or cabinet (not shown); or, as shown in FIG. 7, the rear face 300*a* of the bracket 300 can be molded with a contour such as surface 300*b* to mate against an upright post such as a vertical post P on a forklift's roll cage, to be secured around the post with straps 300*c* through slots 300*d* (and optionally with screws or bolts through mounting holes 300*e*). Bracket 300 has a wide, preferably belled mouth 303 to make it easy to insert dispenser 100 generally horizontally into the bracket. Dispenser 100 is provided with mounting rails 104*d*, previously illustrated but as yet undescribed, which mate with the bracket in two ways: for a one-handed dispensing mode, with the rear or tape-roll end of the dispenser inserted first, in which the rails 104*d* are mated with locking slots 306 in a two-step motion, as best shown in FIGS. 5A and 5B; and, for quick storage while in shipping-tape mode, inserted blade-end (front end) first into the bracket with rails 104*d* resting on the forward-most, downwardly-angled interior shoulders 303*a* formed on the inner surfaces of sidewalls 302, as shown in FIG. 5C.

FIG. 5 shows the dispenser 100 being inserted into bracket 300 rear-end first, for temporary but rigidly secured mounting in a one-handed dispensing mode. Rails 104*d* are inserted above cam surfaces 308, until they engage the flexible cantilevered locking legs 310 at the rear of slots 306 (FIG. 5A). The rear ends of the rails 104*d* at this point are lower than their forward ends, such that the forward ends have to be cammed down over surfaces 308, in the direction of the arrow in FIG. 5B, under tension from locking legs 310 as the locking legs are flexed rearwardly, until the forward ends of the rails 104*d* snap into place underneath cam surfaces 308 (FIG. 5B). Dispenser 100 is now securely mounted in the bracket, locked both horizontally and vertically, and held rigidly enough that tape 16 can be re-routed from its normal application position (FIG. 5A), feeding directly off the roll across bar 124 and over the top of blade 120 (FIG. 5B), sticky side down, for one-handed dispensing and cutting from the bracket-mounted dispenser. Before doing so, however, the track-mounted, curved press-plate 122 must be retracted down in track 122*a* to the position shown in FIG. 5B by depressing buttons 126 and pushing the unlocked press plate down.

Figure 5C:
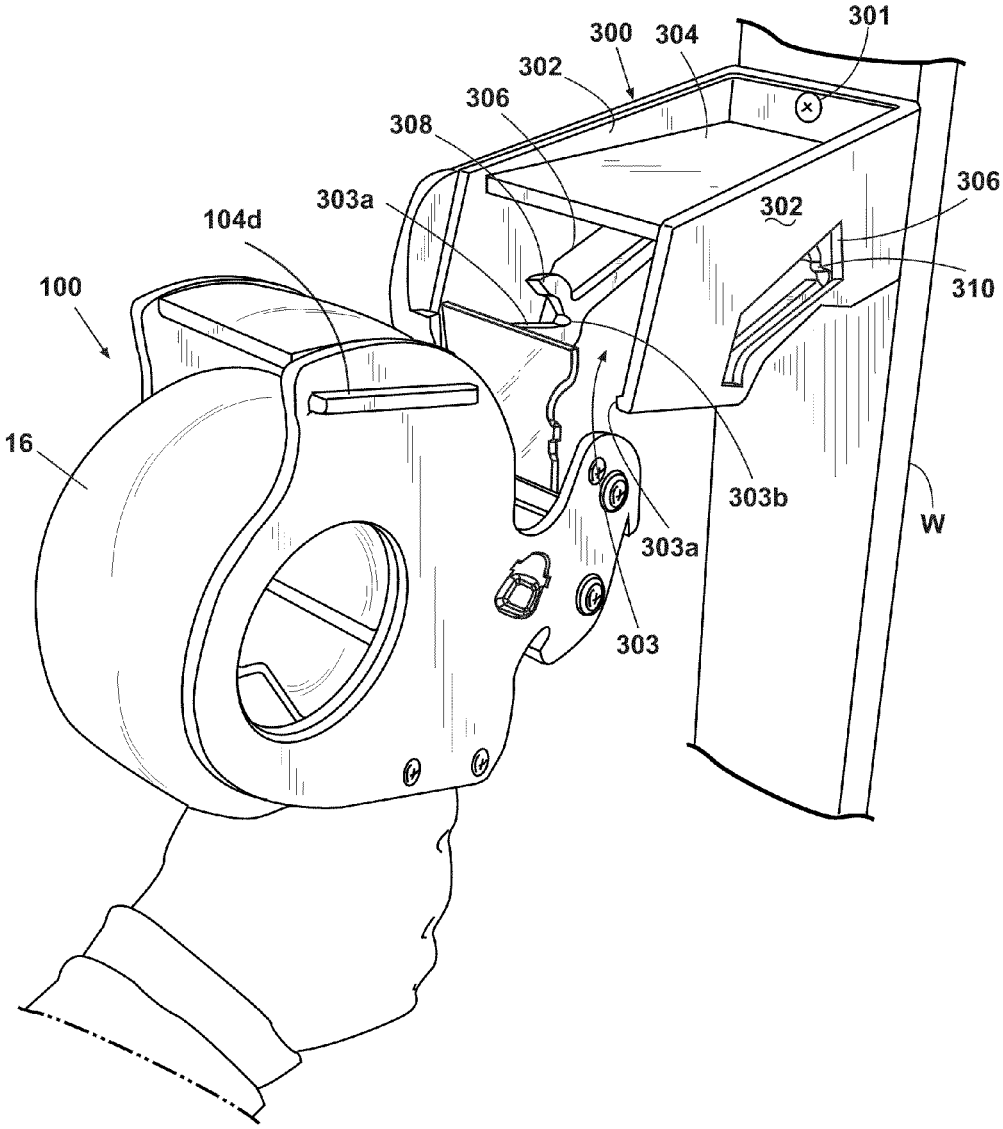
FIG. 5C is a perspective view of the bracket of FIG. 5, with the dispenser reversed for insertion in a quick-storage mode.
Figure 5D:
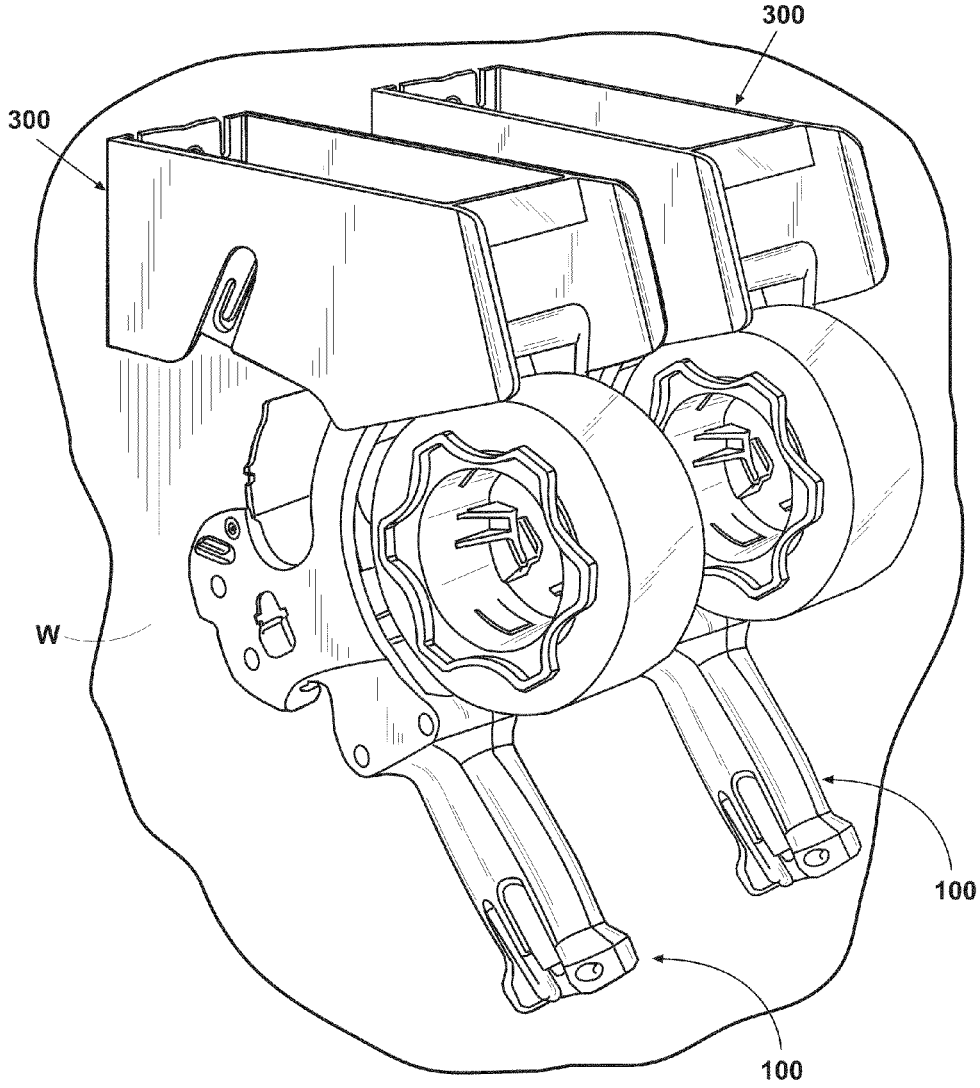
FIG. 5D is a perspective view of two tape dispensers fully inserted in two of the inventive brackets in quick storage mode against a wall.

FIG. 5C shows dispenser 100 being inserted in bracket 300 for quick storage and access in its shipping-tape mode, with rails 104*d* simply resting on shoulders 303*a* in the forward part of bracket 300, with the rear ends of rails 104*d* trapped in suitable pockets or detents 303*b* formed in the underside of cam elements 308 at the rear ends of shoulders 303*a*. The downward angle of shoulders 303*a* and the angle of rails 104*d* on the dispenser and the weight distribution of the dispenser serve to keep the dispenser in place in bracket 300 in this mode. Blade 120 is accordingly stowed facing the wall W, safely away from people walking near the bracket-stowed dispenser 100. FIG. 5D shows a pair of dispensers 100 stored in a pair of brackets 300 mounted on a wall W, having been inserted in the quick-stow mode of FIG. 5C.

Figure 6:
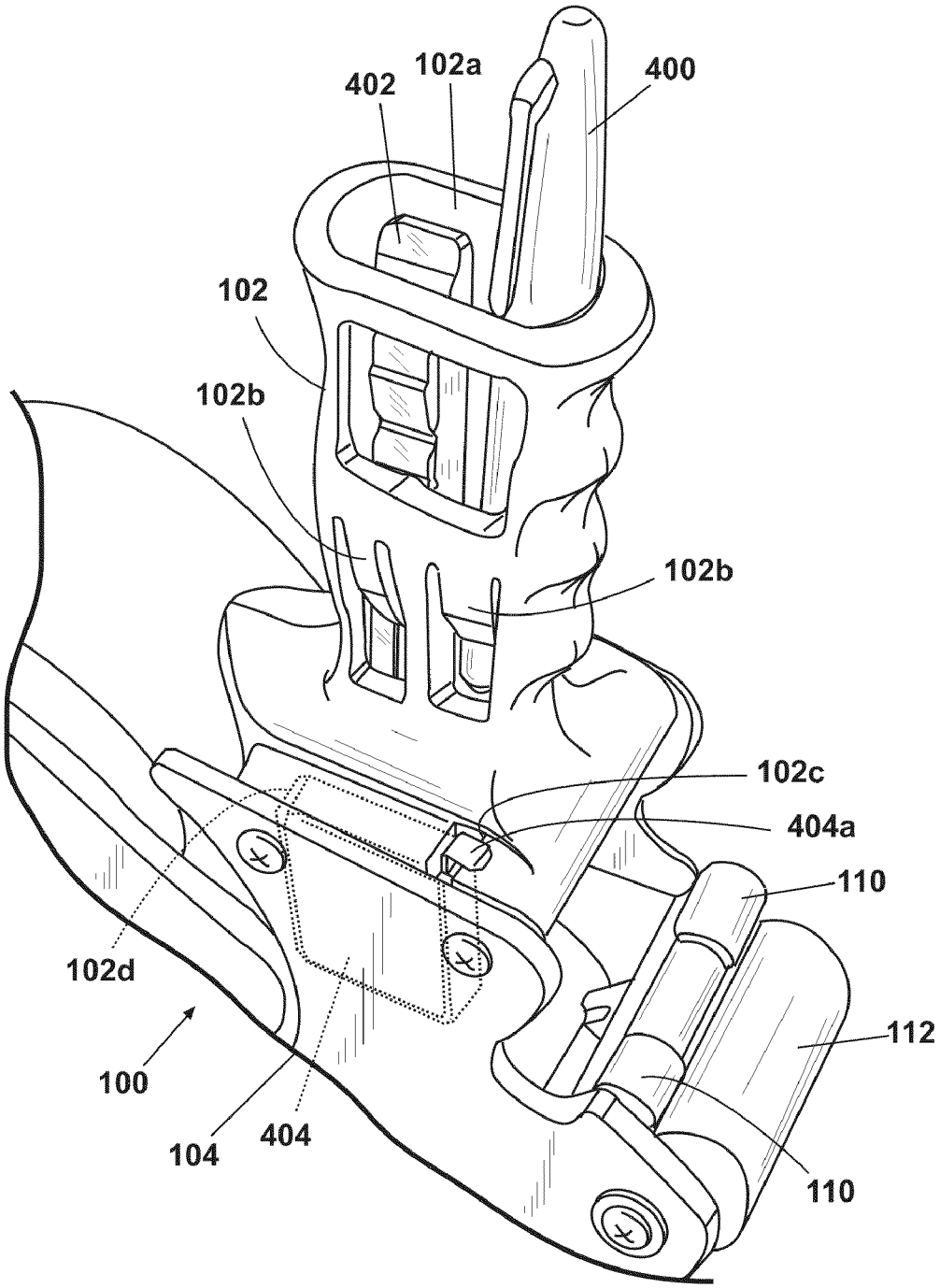
FIG. 6 is an upside-down perspective view of the handle portion of the tape dispenser of FIG. 2, modified with a storage compartment in the handle to store packaging tools, and further modified with a retractable tape measure.
Figure 6A:
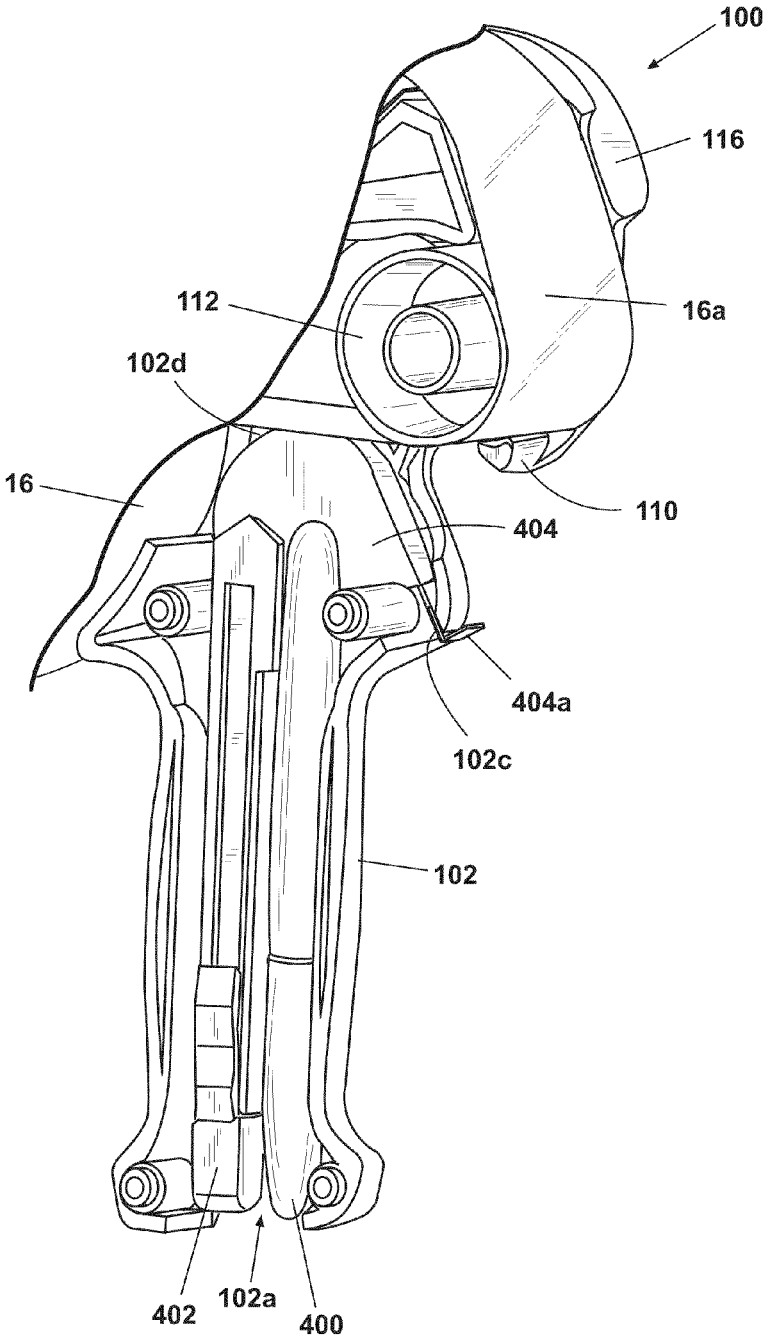
FIG. 6A is a right-side up perspective cutaway view of the handle of FIG. 6.

FIGS. 6 and 6A show dispenser 100 with a hollow handle 102, having a well 102*a* molded therein to provide storage volume for packaging tools such as pen 400 and box-cutter 402. The pen and box-cutter, or any other elongated tool or accessories, are held securely in place with cantilevered fingers 102*b* molded into the handle and normally biased into contact with the inserted tools to frictionally hold them in the handle. The tools 400 and 402 can simply be pulled out to overcome the friction of fingers 102*b*.

FIGS. 6 and 6A also show a retractable tape measure 404 stored or built into dispenser 100, with its free end 404*a* projecting through a slot or hole 102*c* formed in the upper end of the handle platform for quick access while holding the dispenser by the handle. In the preferred, illustrated embodiment, tape measure 404 is a separately-formed item of known type, useful on its own apart from the dispenser, the dispenser 100 having a compartment 102*d* formed on inside surfaces of the junction of the upper end of the handle 102 and frame 104 to insert and remove the tape measure as needed, for example by unscrewing and removing the adjacent sidewall 104*a-b*.

Figure 6B:
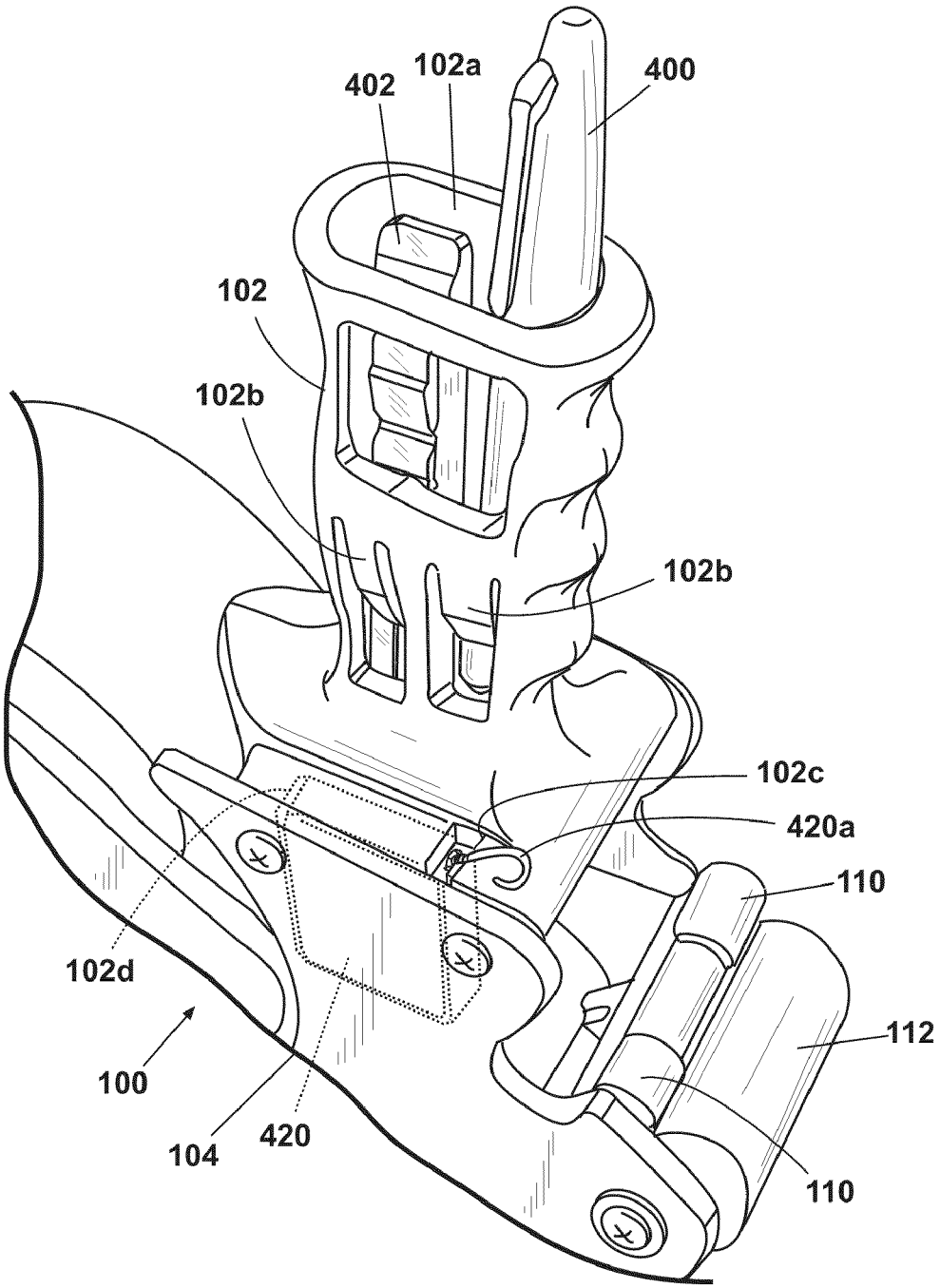
FIG. 6B is similar to FIG. 6, but shows a small digital scale with a weigh hook in place of the tape measure.

FIG. 6B shows the dispenser 100 with the tape measure accessory replaced with a small digital scale 420 of known type, with a weigh-hook 420*a* projecting through slot 102*c* for quick access while holding handle 102. In this embodiment, compartment 102*d* would be formed to the shape of the scale 420 rather than the tape measure. It will be understood by those skilled in the art that dispenser 100 could be provided with both the tape measure 404 and the scale 420, with one located on each side of handle 102 using an appropriately formed compartment and access slot.

FIG. 7 shows the rear face 300*a* of bracket 300 modified with a post-engaging contour 300*b*, in the illustrated embodiment sized and shaped to mate against the side surface of a vertical post P on a forklift roll-cage of known type. Straps 300*c*, for example, fastened with hook-and-loop material or with a fixed tie, wrap around post P and through slots 300*d* formed in the upper and lower ends of the rear face 300*a* of the bracket. Optional screw-mounting holes 300*e* can also be formed in the contour 300*b* to allow direct and more permanent mounting of the bracket 300 to the post P with screws or bolts. It will be understood that contour 300*b* can be adapted to many different types of post or other upright support.

Figure 8:
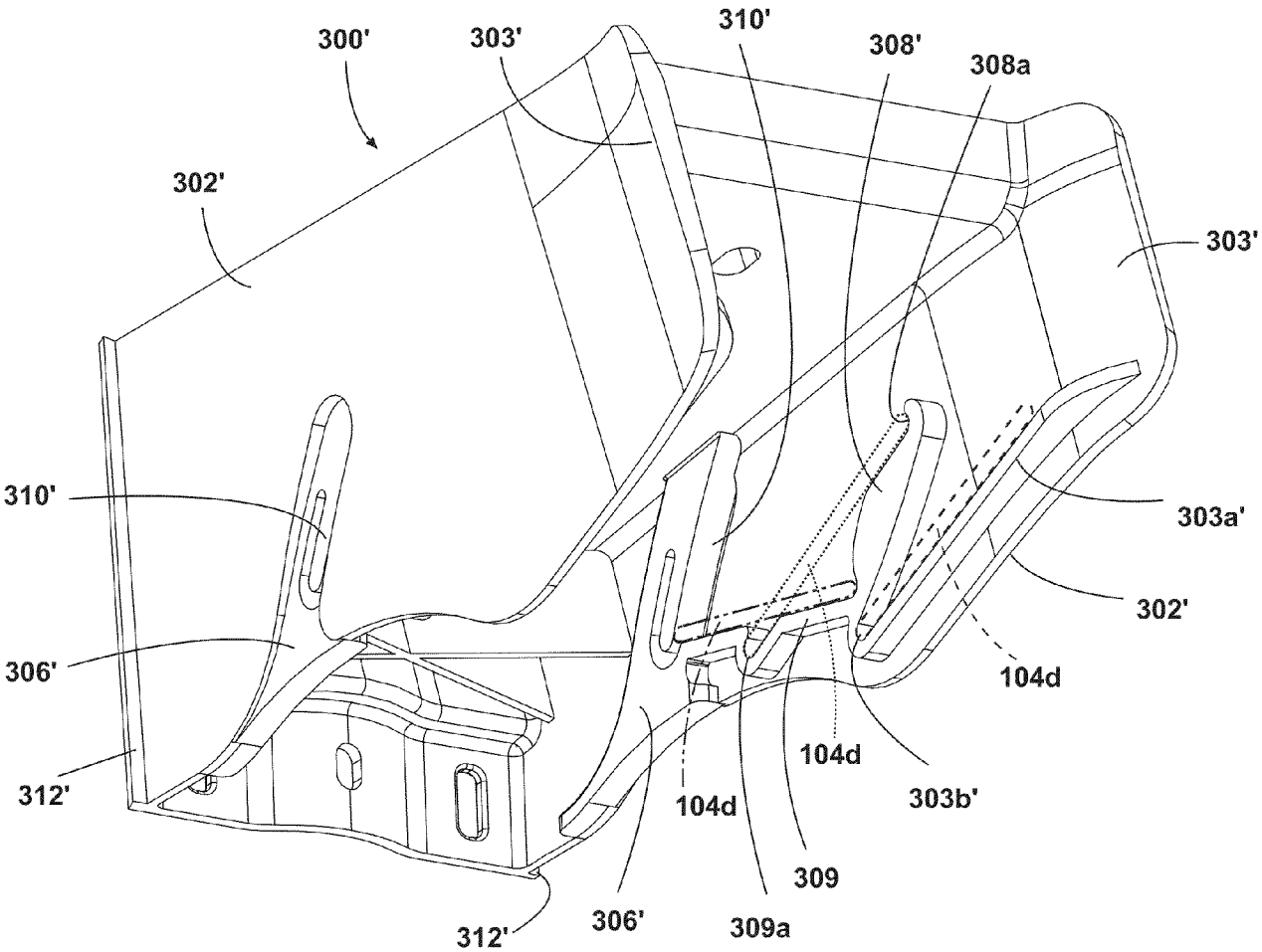
FIG. 8 is a lower front perspective view of a mounting bracket for a tape dispenser of the type illustrated above, the bracket being similar to that in FIG. 5 but modified to provide the option of a third storage condition.
Figure 8A:
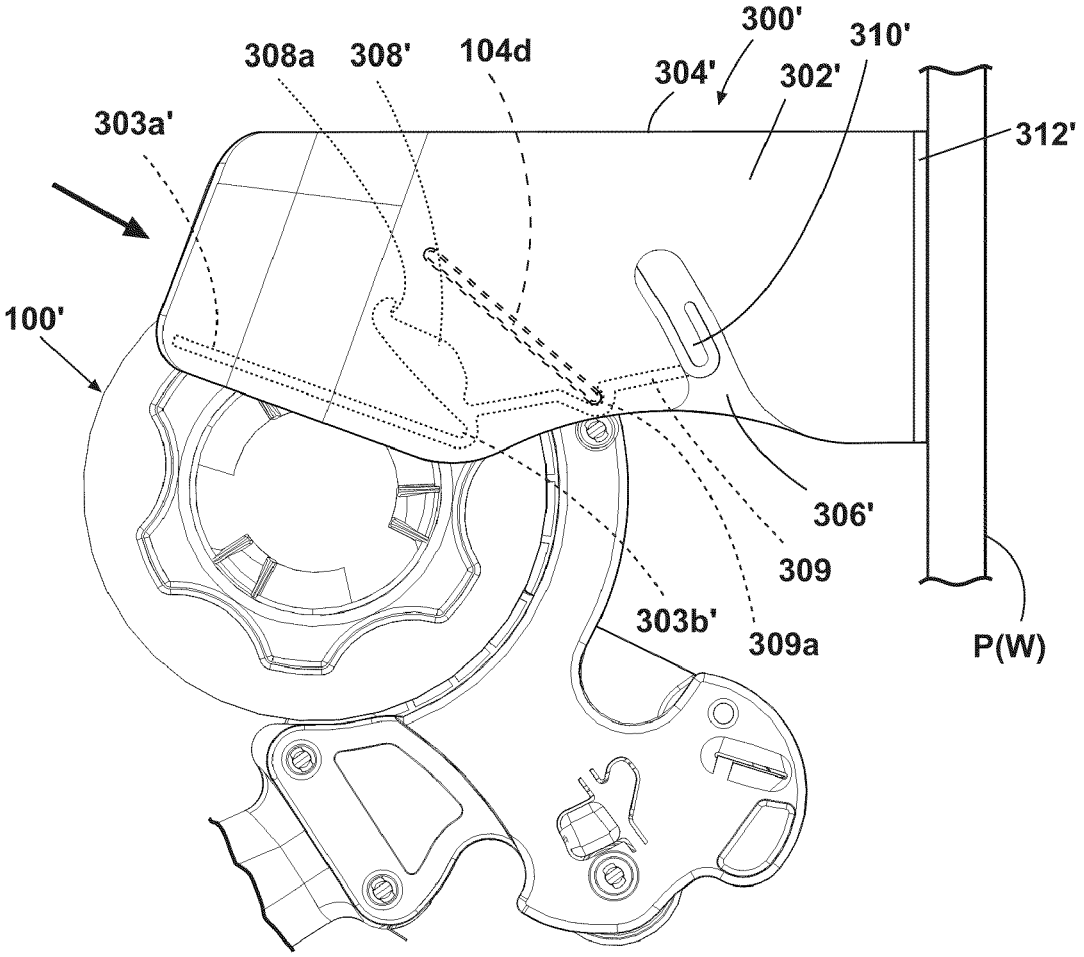
FIG. 8A is a side elevation view of the mounting bracket of FIG. 8 mounted on a vehicle post, showing a tape dispenser initially entering the third storage condition in the bracket.
Figure 8B:
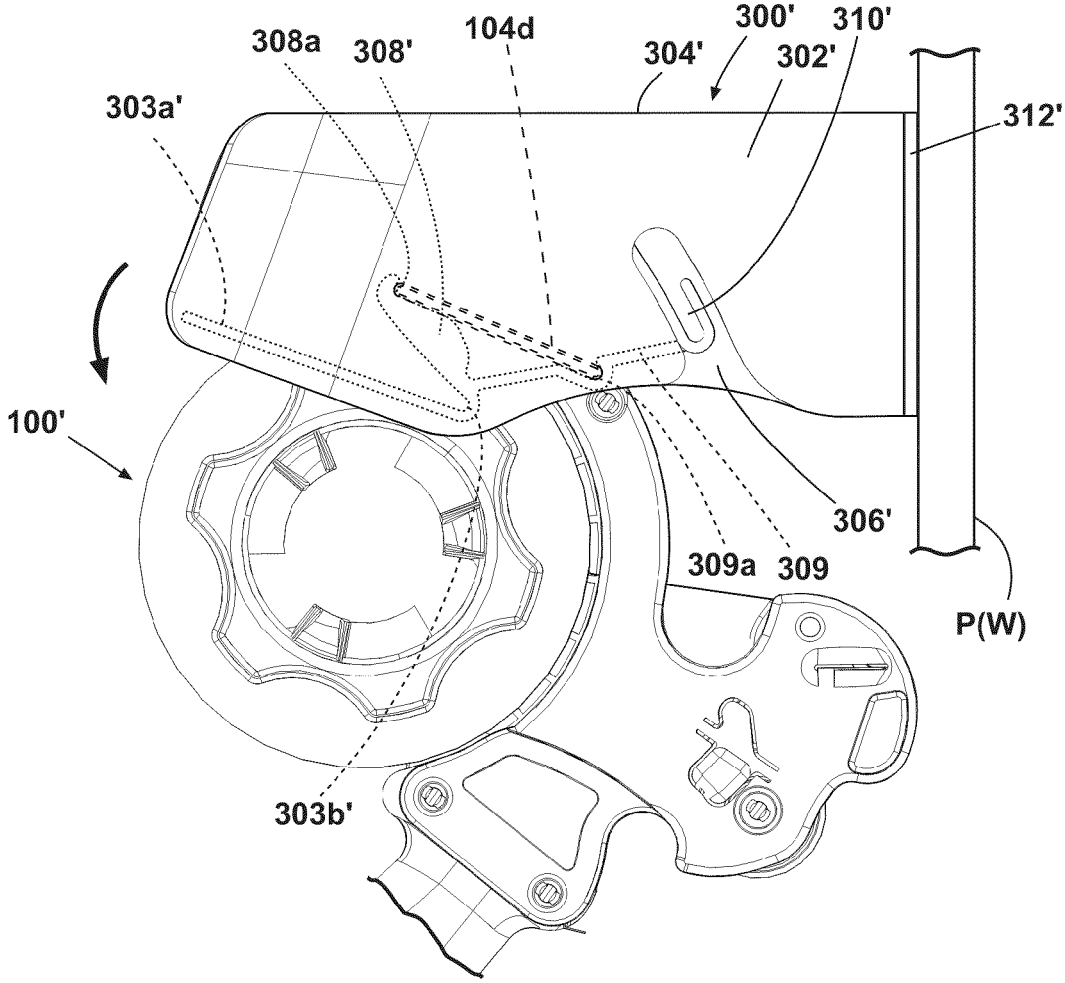
FIG. 8B is similar to FIG. 8A, but shows the dispenser in the third storage condition.
Figure 8C:
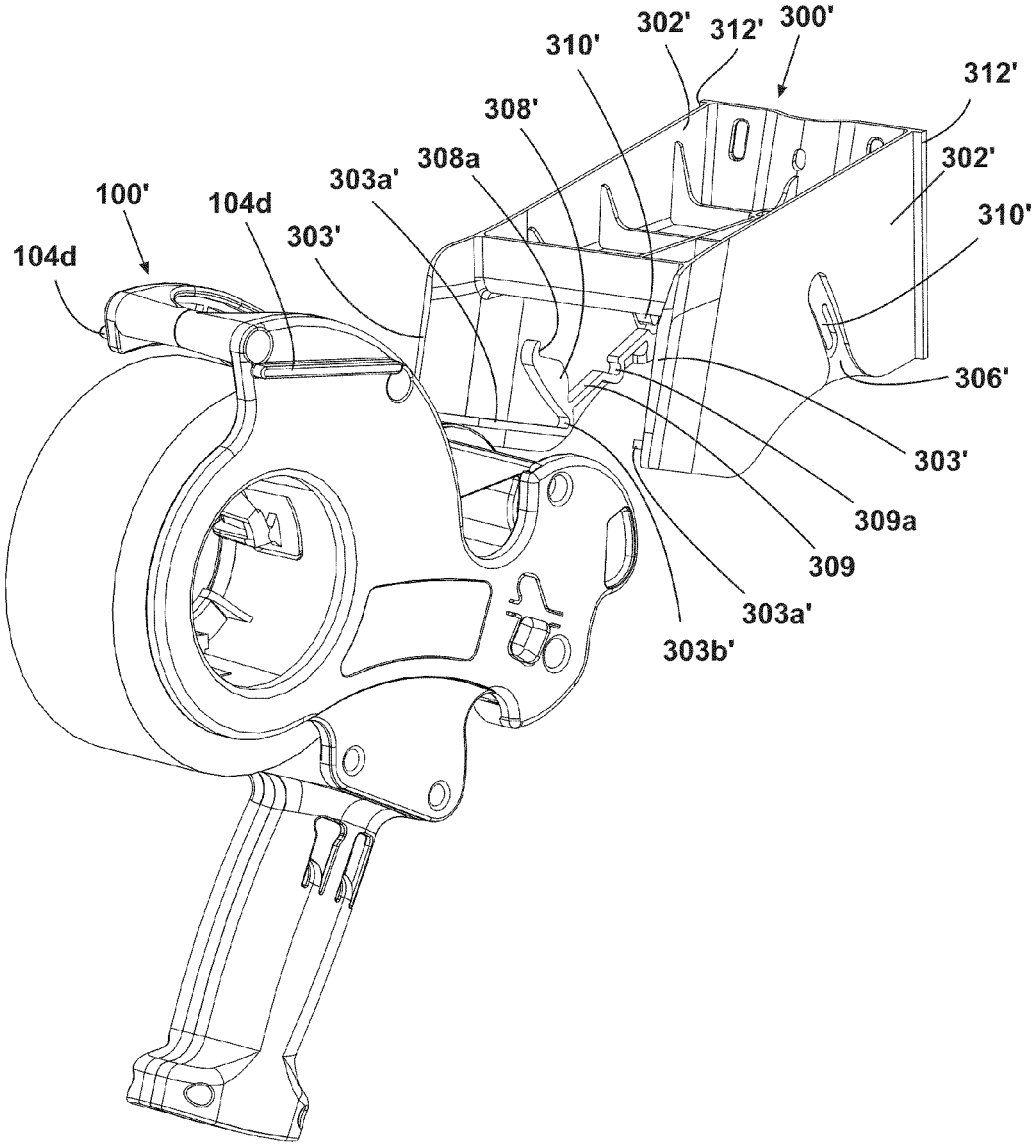
FIG. 8C is an upper front perspective view of the bracket of FIG. 8, with a tape dispenser aligned with the bracket prior to engaging the bracket in the third storage condition.

FIGS. 8 through 8C show a bracket 300' similar to that in FIG. 5, but modified to provide the option of a third storage condition in which the dispenser 100' (or 100) is quickly and easily stored in the bracket blade-end first, but more securely than the first quick-stow option shown in FIGS. 5C and 5D. The slots or shelves 309 formed along the inner sidewall of the bracket between locking legs 310' and cam surface members 308' are each provided with an intermediate pocket 309*a* shaped to receive one end of a rail 104*d*, as shown in FIG. 8A. The upper end of cam members 308' are each modified with a pocket 308*a* shaped to receive the other ends of rails 104*d*, as shown in FIG. 8B, with the spacing of the two pockets 309*a* and 308*a* being equal to or preferably slightly less than the length of rails 104*d* to place the rails 104*d*, and thus the dispenser 100', under tension as the upper ends of the rails 104*d* are forced into upper pockets 308*a*. It would also be possible to make cam members 308' flexible, in the manner of locking legs 310', by spacing them from the sidewall (for example by slotting the sidewall as shown adjacent 306'), in order to flex to accommodate longer rails 104*d* under tension. FIG. 8 illustrates the respective positions of dispenser rails 104*d* in the three storage conditions: the alternating broken line representing the blade-out, one-handed dispensing mount of FIG. 5B; the dashed broken line representing the blade-in, quick-stow mount of FIGS. 5C and 5D; and the dotted broken line the intermediate blade-in storage position of FIG. 8B. FIG. 8C gives a further idea of the direction and angle at which dispenser 100' is oriented and inserted into bracket 300' for this third storage condition. This intermediate blade-in storage condition is especially useful where bracket 300' is subject to vibration or jostling, for example if mounted in a vehicle or in tight quarters where the dispenser might be bumped by a person passing by.

Figure 9:
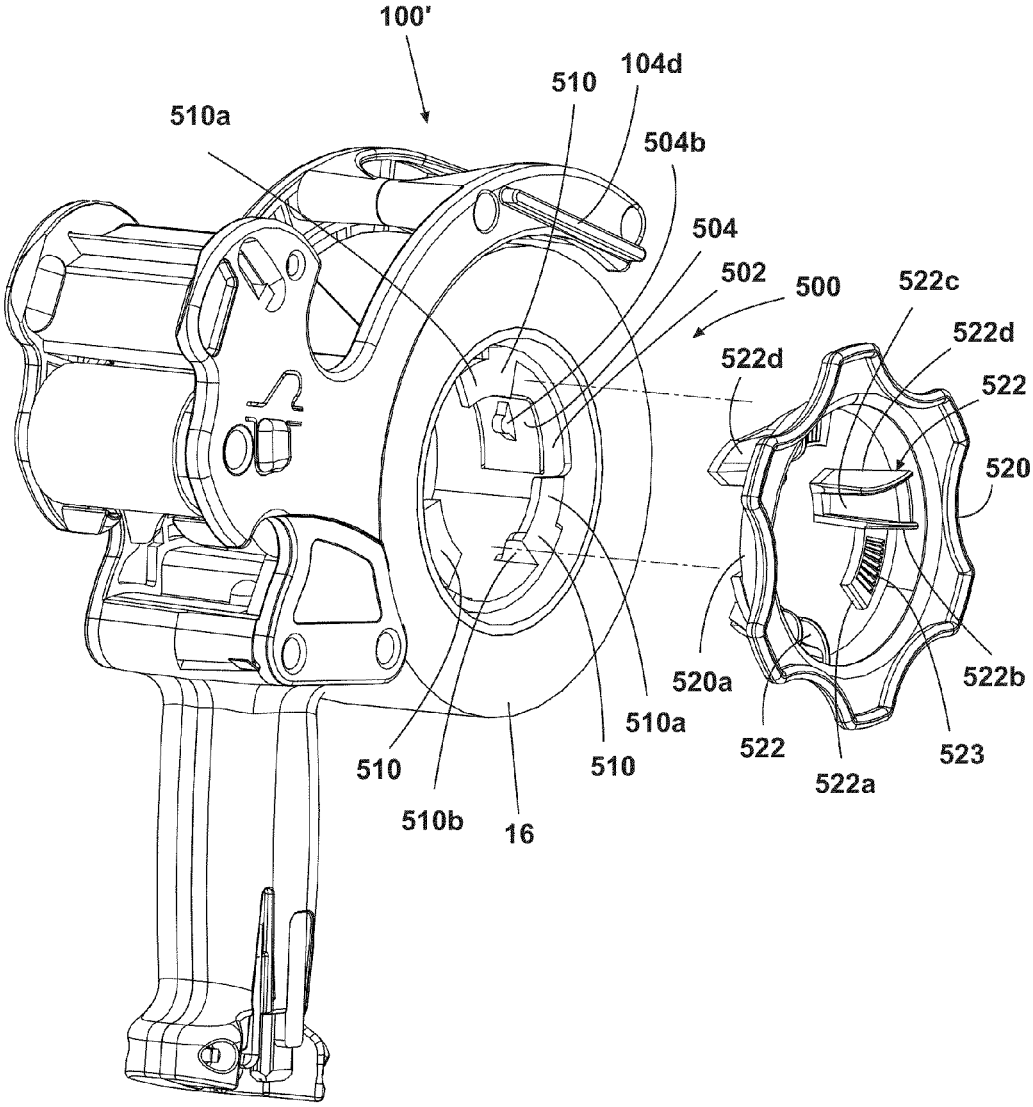
FIG. 9 is a perspective view of a shipping tape dispenser similar to that illustrated above, but with an improved spool assembly that can adjustably tension a roll of tape.
Figure 9A:
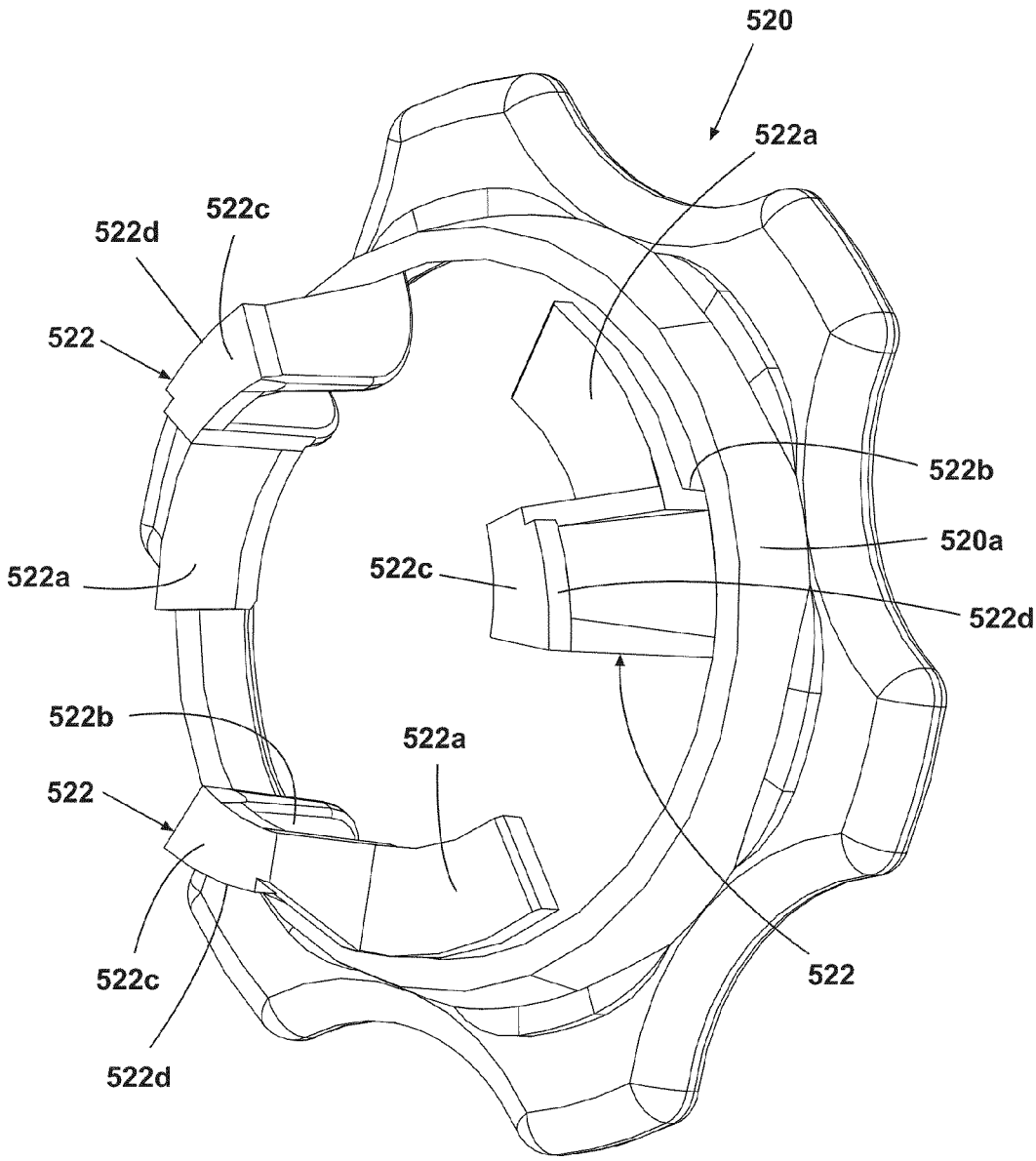
FIG. 9A is a perspective view of the inner side of a removable hub portion of the spool assembly of FIG. 9.
Figure 9B:
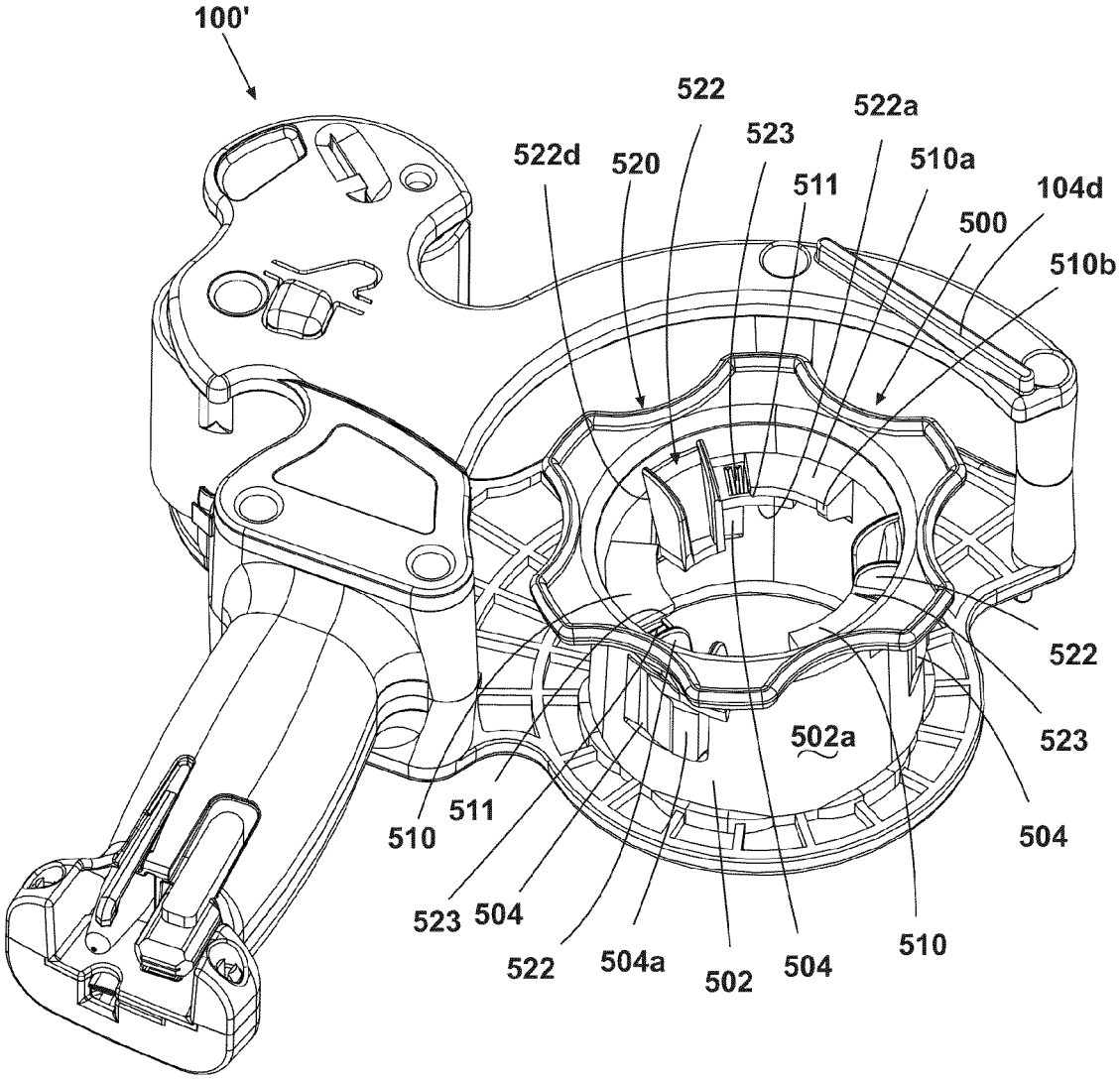
FIG. 9B is a perspective view of the spool assembly of FIG. 9, with the hub rotated to a lightly tensioned position.
Figure 9C:
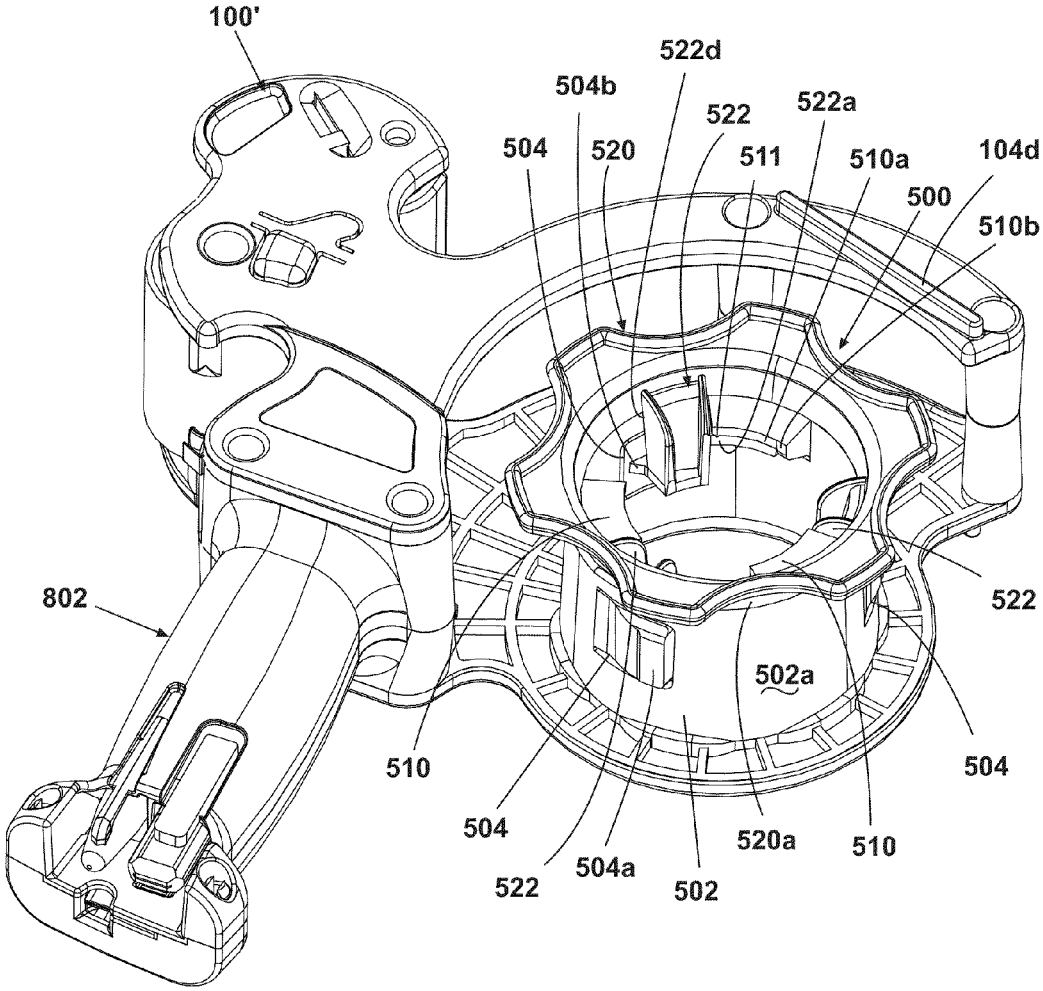
FIG. 9C is similar to FIG. 9B, but with the hub rotated to a fully tensioned position.

FIGS. 9 through 9C illustrate a modified spool assembly 500, with a spool tensioning structure that sufficiently deters reverse rotation of the roll of tape 16 on the spool, while also allowing the tape-dispensing tension on roll 16 to be fine-tuned for more efficient application of tape. Spool assembly 500 has two major parts: a spool portion 502 fixed on the main body of dispenser 100', for example molded integrally therewith, and sized to rotationally support a roll of tape; and a removable hub portion 520 that rotationally mates with fixed spool portion 502 through a roll of tape to axially secure the roll of tape on the spool assembly. In the illustrated embodiment, spool portion 502 has a length approximating or exceeding the width of the roll of tape, so that it provides a major tape rolling surface 502*a* for the tape, while removable hub 520 provides a smaller, but complementary, portion 520*a* of the overall tape-rolling surface when mated with portion 502. The width of the combined surfaces 502*a* and 520*a* of the mated spool portions is at least slightly greater than the width of the roll of tape for which the dispenser is designed, allowing the tape to roll freely, subject to the degree of tensioning applied through hub 520.

The interior of fixed spool portion 502 is provided with plural, generally L-shaped locking lugs 510, with curved cantilever arms 510*a* terminating in axial stops 510*b*. Spool portion 502 also has a plurality of frictional resistance elements in the form opf cantilever tape-tensioning tabs 504 formed therein, with outer ramped protrusions 504*a* extending above the rolling face 502*a*, and inner projecting cam actuator knobs 504*b*. Tabs 504 are flexible, so that ramps 504*a* can be moved more or less forcefully against the interior surface of a roll of tape 16 mounted on the spool.

Hub 520 is provided with complementary locking lugs 522 having curved cantilever arms 522*a* terminating in axial stops 522*b*, arms 522*a* being designed to rotationally mate with arms 510*a* on fixed spool 502 to prevent hub 520 from being pulled off spool 502. Lugs 522 are additionally provided with axial extensions or posts 522*c* extending inwardly to overlie the interior surface of spool portion 502 when the spool and hub are mated. The inner, progressively curved or ramped cam faces 522*d* on lugs 522 are positioned to be rotated over actuator knobs 504*b* on the inside surfaces of tape-tensioning tabs 504, in order to progressively cam the tabs 504 outwardly against a roll of tape on the spool assembly. Thus, the cam faces 502 and ramped protrusions 504*a* provide an interengaging cam and cam follower mechanism for adjusting the frictional resistance between the frictional resistance elements and the roll of tape.

Arms 522*a* are additionally provided with ratchet-type adjustment indicator teeth 523 on their outward-facing sides, designed to ratchet over a small detent or pawl 511 on the mating, inward-facing surface of each arm 510*a* when the hub and spool are rotationally mated. The ratchet connection between the mating lock arms provides a tactile, audible, and visual indication of the extent to which the arms have been mated, and the corresponding extent to which lug faces 522*d* have cammed tabs 504 outwardly to frictionally tension the roll of tape on the spool assembly. The rotational mating of hub 520 with fixed spool 502 is positively stopped when the free ends of the lock arms 510*a* and 522*a* come into abutment with the respective axial stops 510*b* and 522*b* on the opposing lug structures. FIG. 9B shows hub 520 rotated partway onto fixed spool portion 502, for a partial tensioning of the tape on the spool assembly. FIG. 9C shows hub 520 fully rotationally mated with spool 502, for maximum tensioning of the tape on the spool assembly. By "tensioning" is meant the frictional resistance exerted by the spool assembly against the rotation of a roll of tape, and the resulting force needed to dispense tape from dispenser 100'. Tape manufacturers use varying tape release rates for their different tape products, and this spool tension-adjusting feature accommodates the different release rates.

Figure 10:
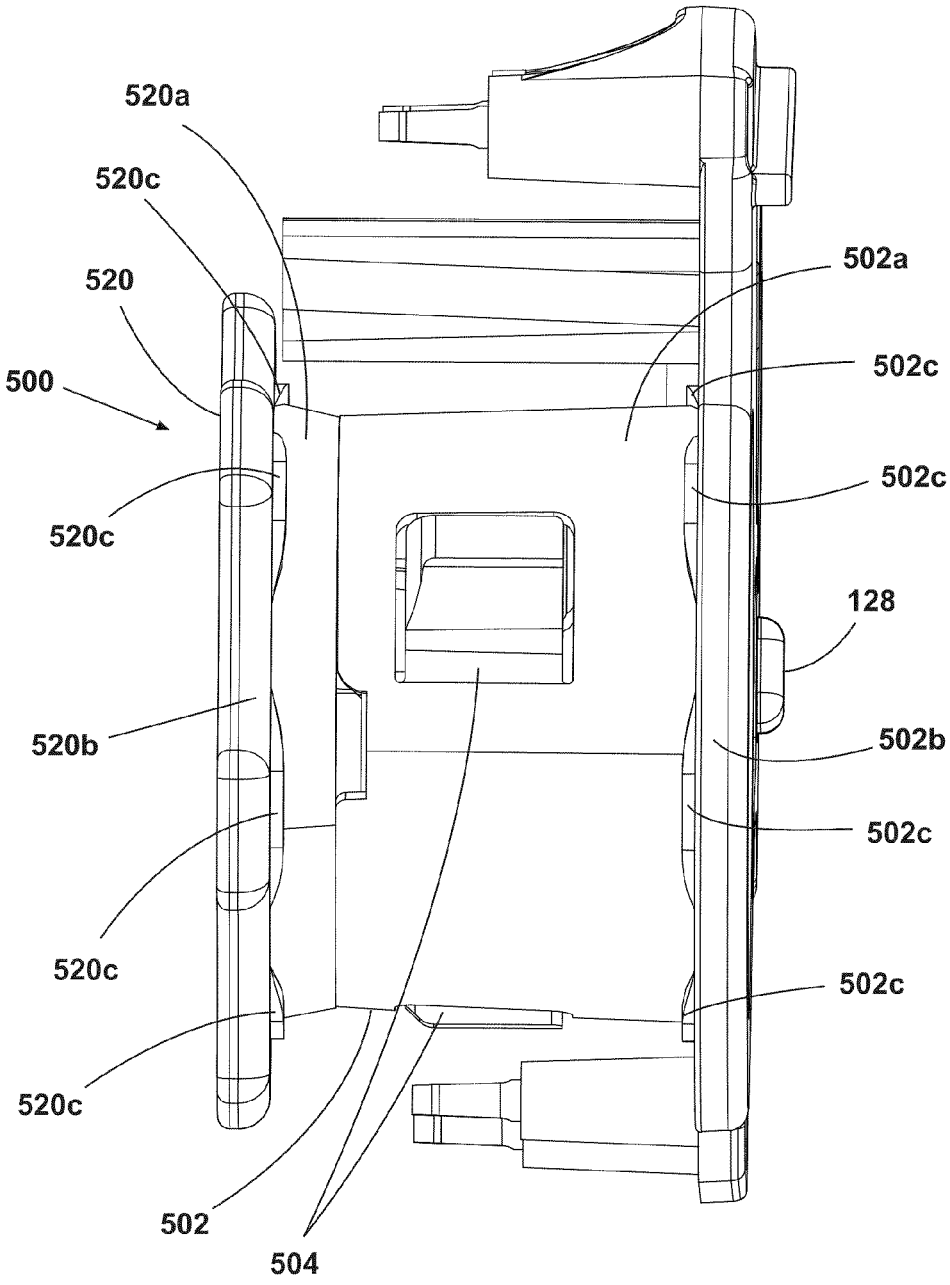
FIG. 10 is a top plan view of the spool assembly of FIG. 9, with the addition of spool surface features that reduce the side-to-side play of a roll of tape on the spool as tape is dispensed.
Figure 10A:
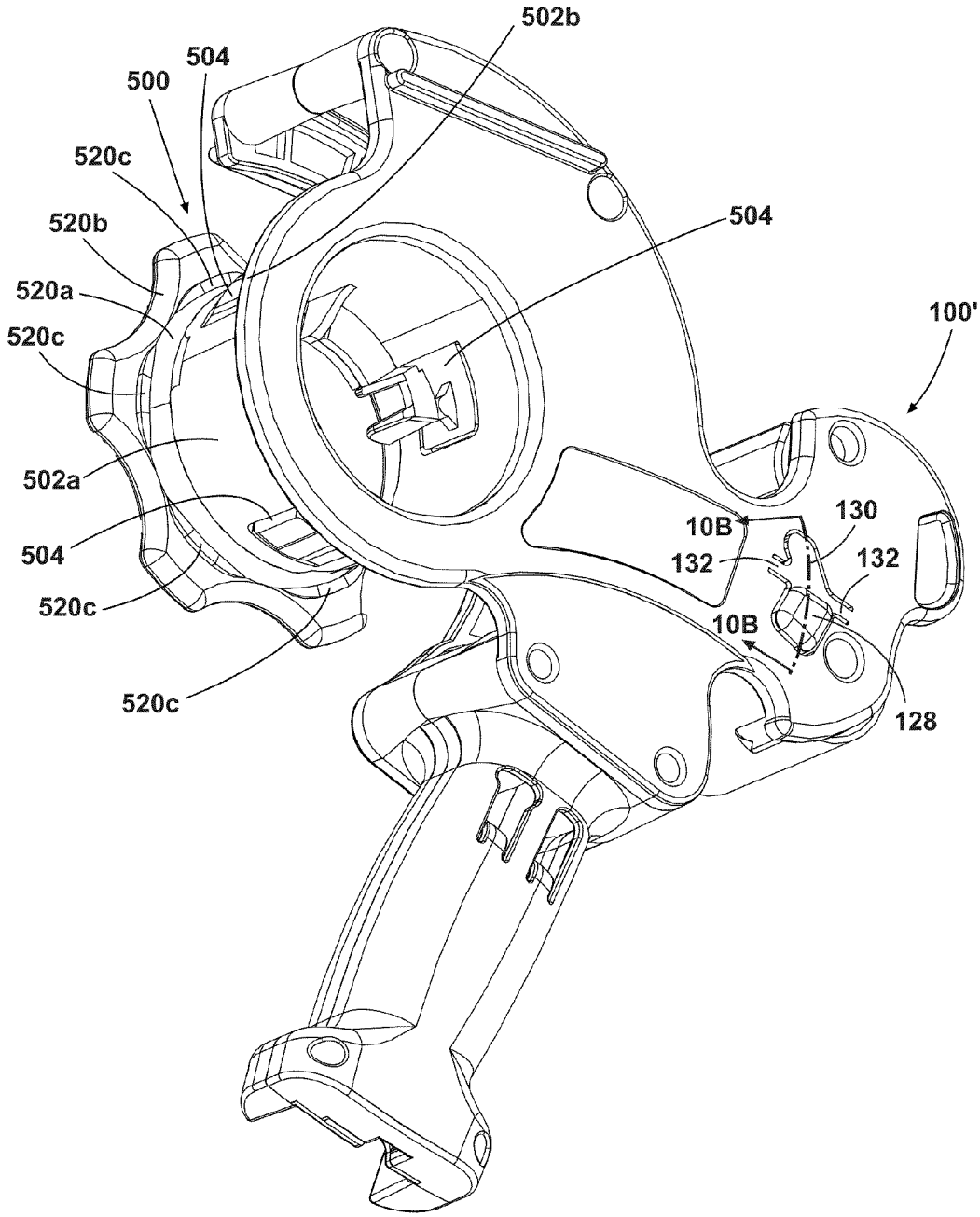
FIG. 10A is a perspective view of the spool assembly of FIG. 10.
Figure 10B:
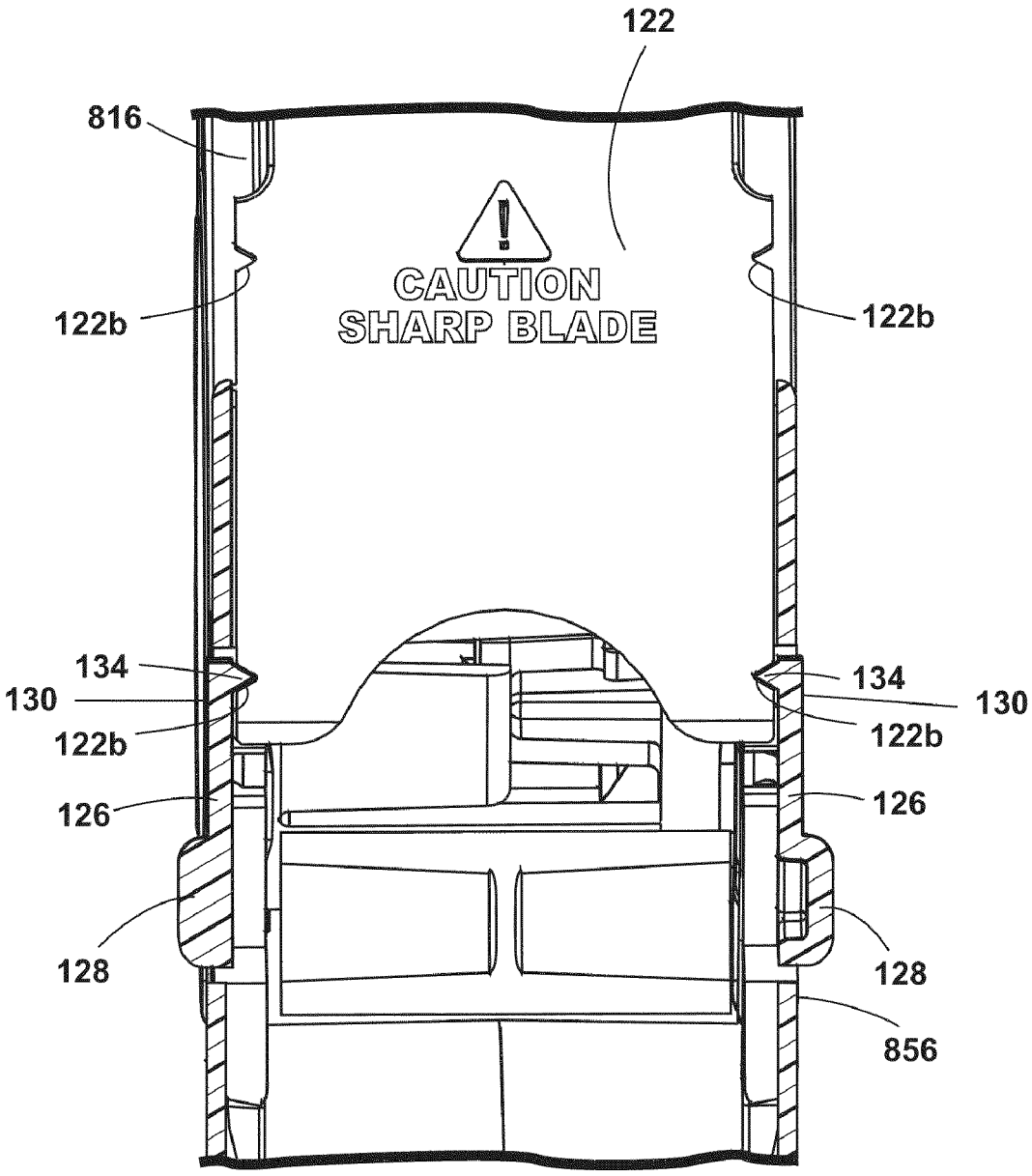
FIG. 10B is a cross sectional view taken along lines 10B-10B of FIG. 10A.

FIGS. 10 and 10A illustrate a ring of intermittent, ramped shoulders 502*c* and 520*c* around each side edge of the spool assembly 500, at the junction with the spool sidewalls 502*b* and 520*b*, in order to decrease side-to-side play of the roll on the spool as tape is dispensed. The roll of tape must be allowed to roll freely on the spool assembly for dispensing, and so the spool face (formed by the mated faces 502*a* and 520*a*) between the sidewalls must be sufficiently wide to accommodate manufacturing variations among the rolls for which the dispenser is designed. The resulting side-to-side movement or "play" of the roll on the spool is often excessive, and can interfere with proper dispensing of the tape through the roller and cutter end of the dispenser. Intermittent shoulders 502*c* and 520*c* reduce this side-to-side play by providing ramped or rounded surfaces, angled downwardly from the spool sidewalls 502*b* and 520*b* toward the adjacent spool faces 502*a* and 520*a*, to engage the interior circumference of the roll of tape without adding undue frictional resistance to the free rolling of the tape.

Figure 11:
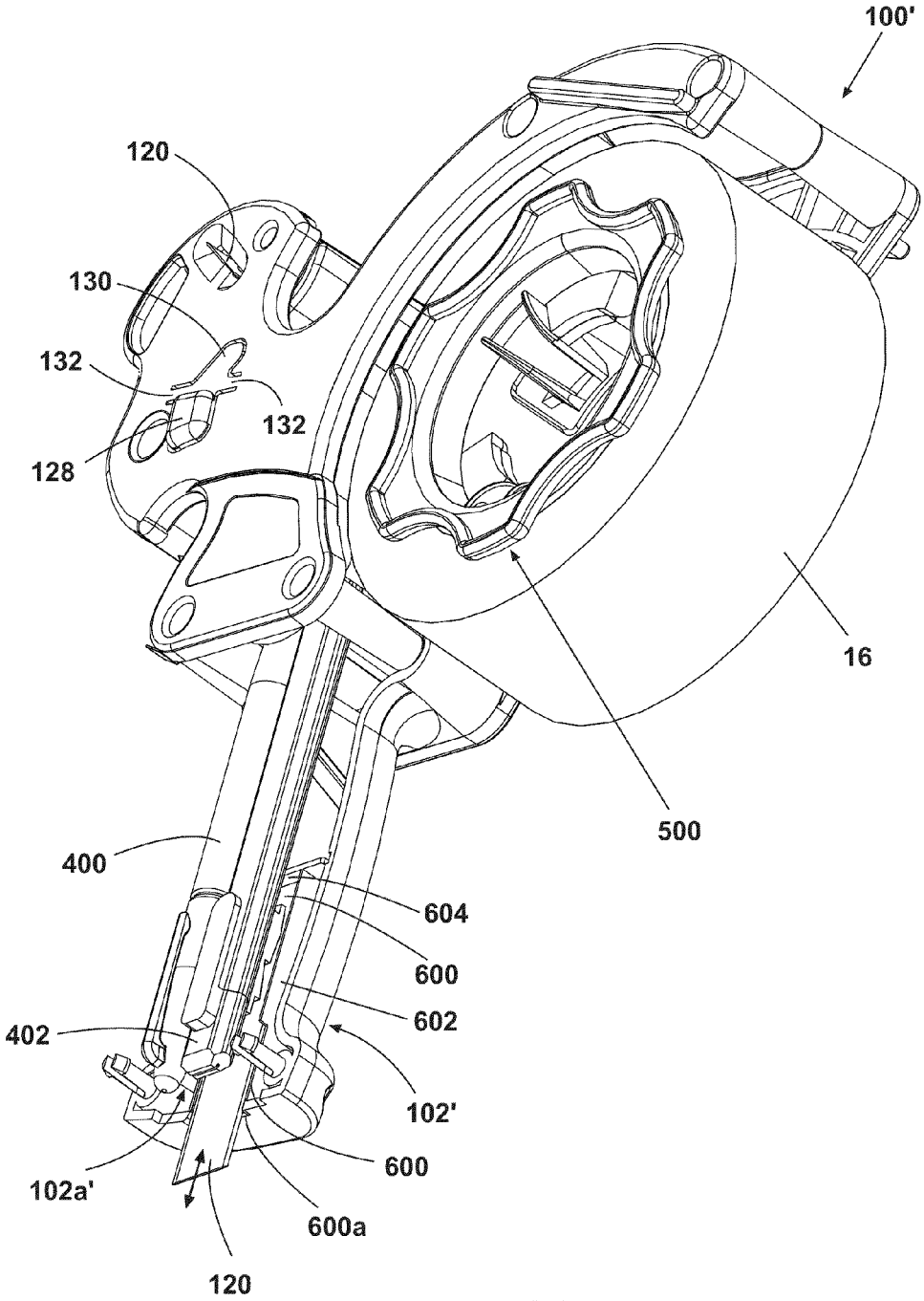
FIG. 11 is a lower perspective view of the handle assembly of a tape dispenser as illustrated above, the handle assembly modified with a blade storage compartment.

FIG. 11 illustrates a dispenser 100' whose handle has a compartment 102*a*' designed to securely store a marking pen 400 and utility cutter 402 as described above in reference to FIG. 6, but is further modified with a blade storage slot 600 to securely hold and store one or more spare cutting blades 120. Blade storage slot 600 in the illustrated embodiment is defined by sidewalls 602 and an end-wall 604, sized to accept a replacement blade 120 inserted through an opening 600*a* in the end of the handle 102'. The blade 120 accordingly fits snugly underneath pen 400 and utility knife 402, held in a friction fit until needed. The end of the blade 120 is exposed through opening 600*a* to allow it to be pulled out using fingers or a small tool.

Figure 12:
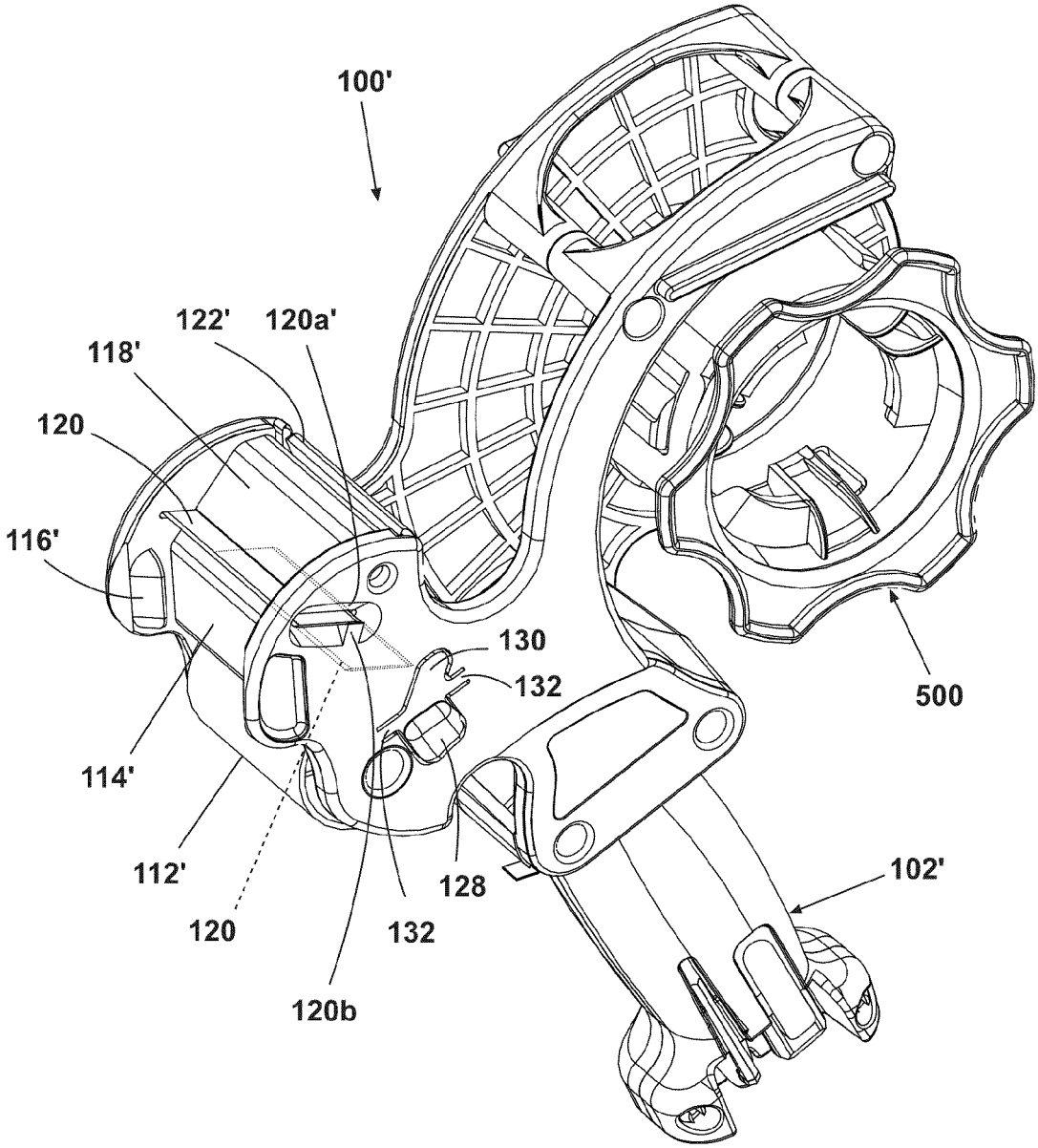
FIG. 12 is an upper perspective view of the dispensing end of a tape dispenser according to the invention, with a transverse blade mounting slot having a misaligned blade tensioning feature.

As shown and described above in connection with FIGS. 2 through 4, the tape dispenser cutting blade 120 is frictionally mounted in a transverse slot having a recessed opening 120*a* through a sidewall portion of the dispensing end or "head" of the dispenser. The friction is such as to require at least some force to push the blade in and to pull it out of the slot. The end of the blade is exposed in the recessed slot opening for removal and replacement with common needle-nose pliers. FIG. 12 illustrates a further form of the blade mounting slot, in which the blade slot opening 120*a*' has a small projection 120*b* misaligned with the slot, so that the flexible metal blade 120 is slightly bent during insertion into and removal from the slot. The blade 120 relaxes once it is fully inserted into the slot, while the misaligned projection 120*b* positively ensures that the frictionally-held blade cannot come out of the slot accidentally. Projection 120*b* is preferably angled or ramped downwardly into the slot on its slot-facing side as shown, for a smooth transition of the blade into and out of the slot. This frictional slot-mounting, particularly with the blade-tensioning projection 120*b* of FIG. 12, has been found not only very convenient for blade removal and replacement, but holds blade 120 very securely in the slot without the need for additional fastening means. The cutting blade 120 is received and retained in the transverse slot by one edge portion of the guide face 114 and one edge portion of the transverse bar 118.

Figure 13:
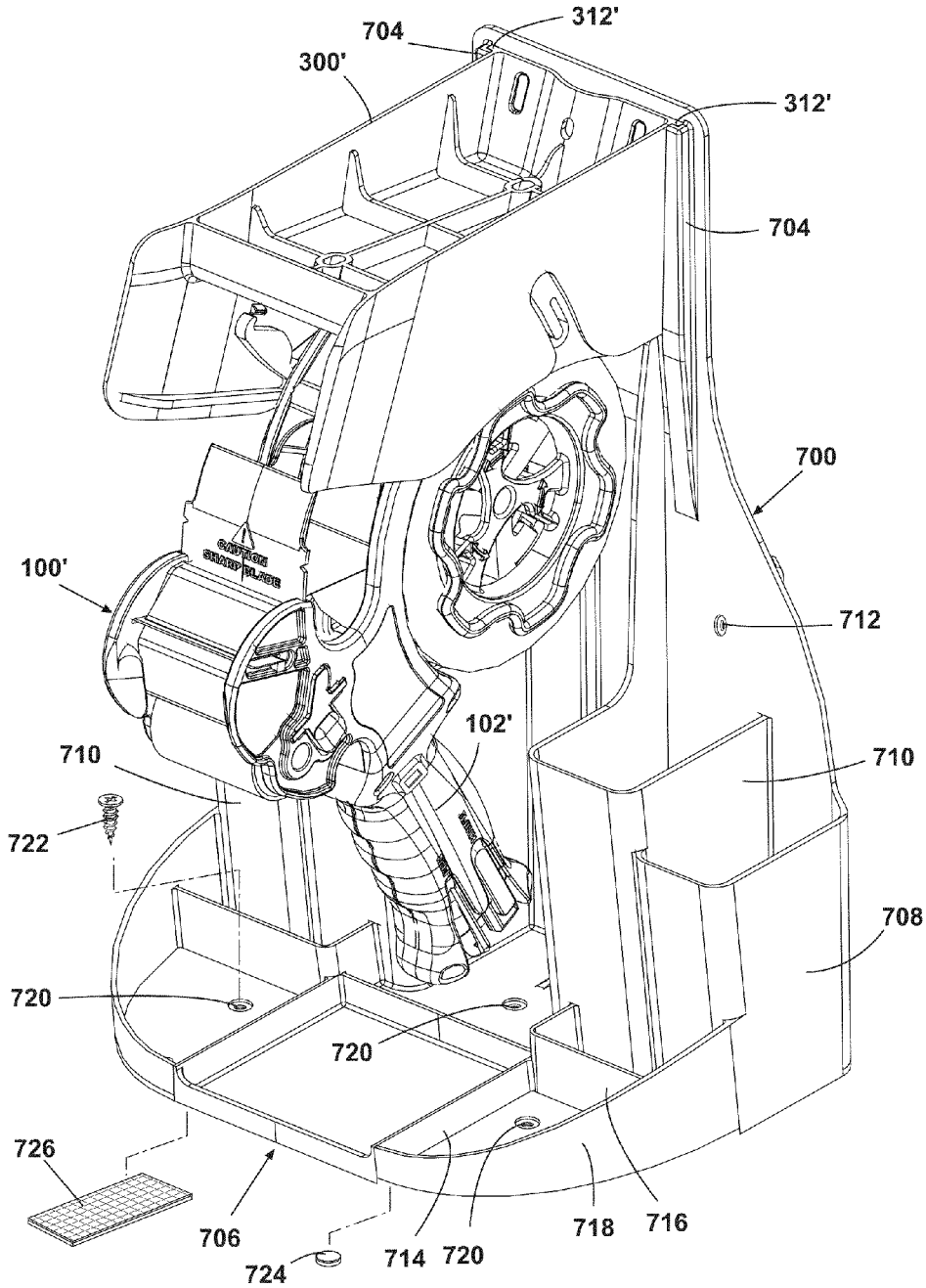
FIG. 13 is a perspective view of a caddy/organizer that is adapted to mount the dispenser mounting bracket 300', which in turn that mounts the dispenser 100'.
Figure 14:
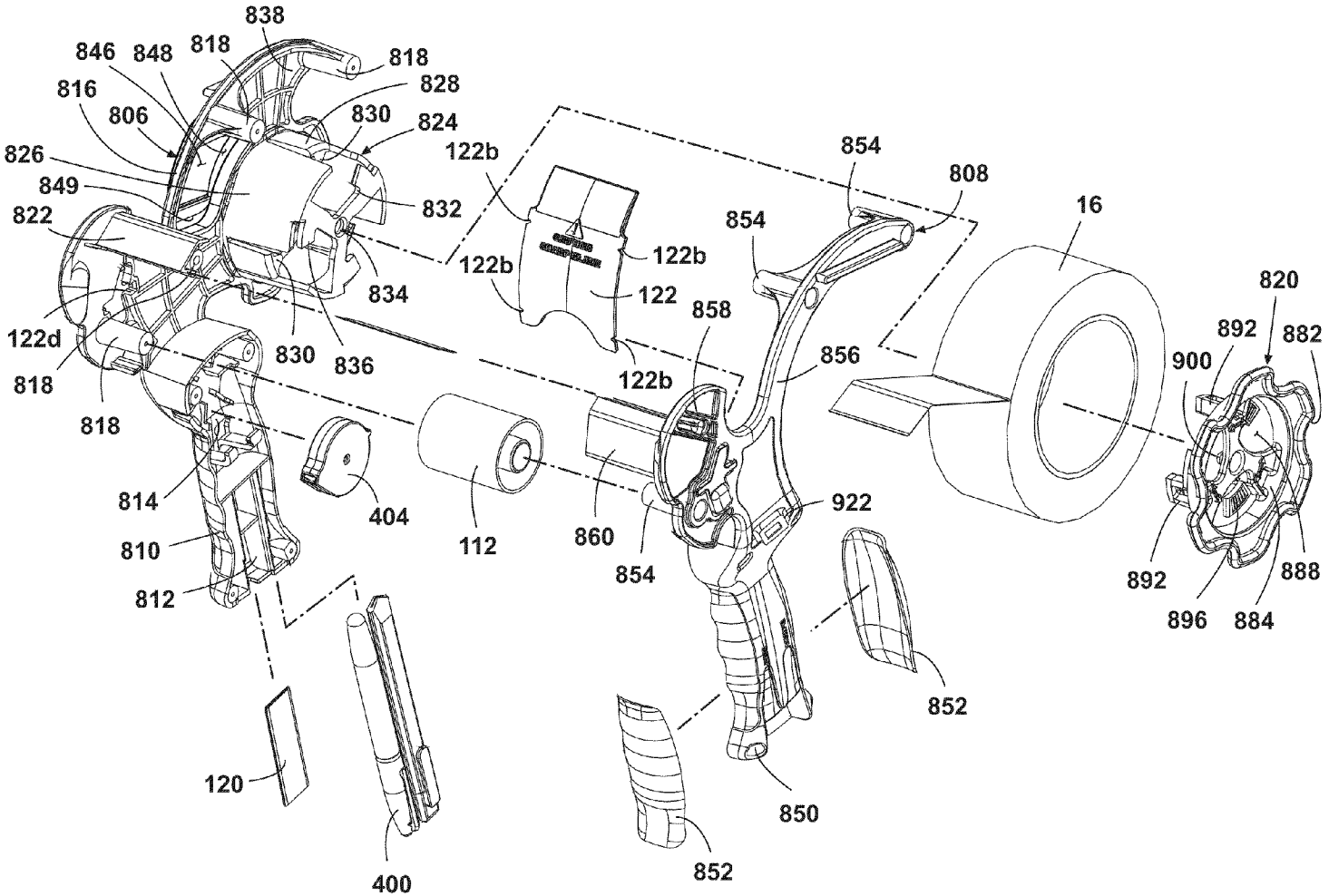
FIG. 14 is in exploded view of a preferred embodiment of the dispenser according to the invention.

Referring now to FIG. 13, there is shown a caddy/organizer 700 having a back wall 702 that forms channels 704 and a base 706. Pockets 708 and 710 are formed at the lower portion of the back wall and screw holes 712 are provided in the back wall for mounting the caddy/organizer onto a wall, if desired. The base 706 has a number of the standing walls 714, 716 and 718 that form trays on the base 706. Screw holes 720 are also provided in the base 706 for mounting the caddy/organizer permanently onto a work surface through screws 22. Rubber pads 724 are also provided on the underside of the base 706 for positioning the caddy/organizer 700 on a work surface, with or without being attached thereto through screws. Additionally, and alternatively, double-sided tape 726 is provided for adhesively securing the caddy/organizer to a work surface.

The dispenser 100' is mounted to the caddy/organizer 700 through the rails 312 that project outwardly from the side walls of the dispenser mounting bracket and through the channels 704 in the back wall 702 of the caddy/organizer. The rails 312 slide within the channels 704 to securely, but releasably, mount the dispenser mounting bracket 300 to the caddy/organizer.

Referring now to FIG. 14-19, there is shown a preferred embodiment of the invention which is similar in some respects to the embodiment 100' discussed above, with like numerals used to describe like parts. A tape dispenser 800 has a grip 802 and a spool assembly 804. The dispenser 800 is basically constructed from three injection molded parts: a main frame half 806, a cover frame half 808, and a hub 820. The main frame half includes a grip portion 810 that has a blade cavity 812, a tape cavity 814 and a spool face portion 816. Hollow projections 818 extend inwardly from the spool face portions 816 as well as from the grip portion 810. A transverse support 822 extends inwardly from the spool face portion 816. A belt clip 846 is integrally molded into the main frame half 806 spool face portion 816, is separated from the spool face portion 816 by an integral slot 848 and cantilevered out from the spool face portion through an integral hinge 847. The belt clip has an upturned end 849 to assist in attaching the dispenser to a belt of a user.

A spool 824 for supporting the tape spool 816 comprises three circumferentially spaced spool support flanges 826 and three tensioning flanges 828 interposed between the spool support flanges 826. A cam 830 extends inwardly from each tensioning flange 828. Spokes 832 extend radially from the inner end of the spool support flanges 826 and meet in a central portion thereof. An opening 834 extends through the central portion of the spokes 832. A retainer flange 836 is cantilevered in a circumferential direction from each of the spokes 832 radially inwardly from the spool support flanges 826. Projections 840 (FIG. 19) extend axially toward the spool face portions 816 from the outer ends of the retainer flanges 836. Strengthening ribs 838 are integrally formed on the inner surface of the spool face portion 816. Gussets 842 (FIG. 18) are integrally formed between the spokes 832 and the spool support flanges 826. An undulating outer edge 844 is formed in an edge of the spool face portion 816.

The cover frame half 808 has a grip portion 850 and hollow posts 854 which extend inwardly from a cover plate half 856. A guide support plate 858 supports a guide face 860.

Figure 15:
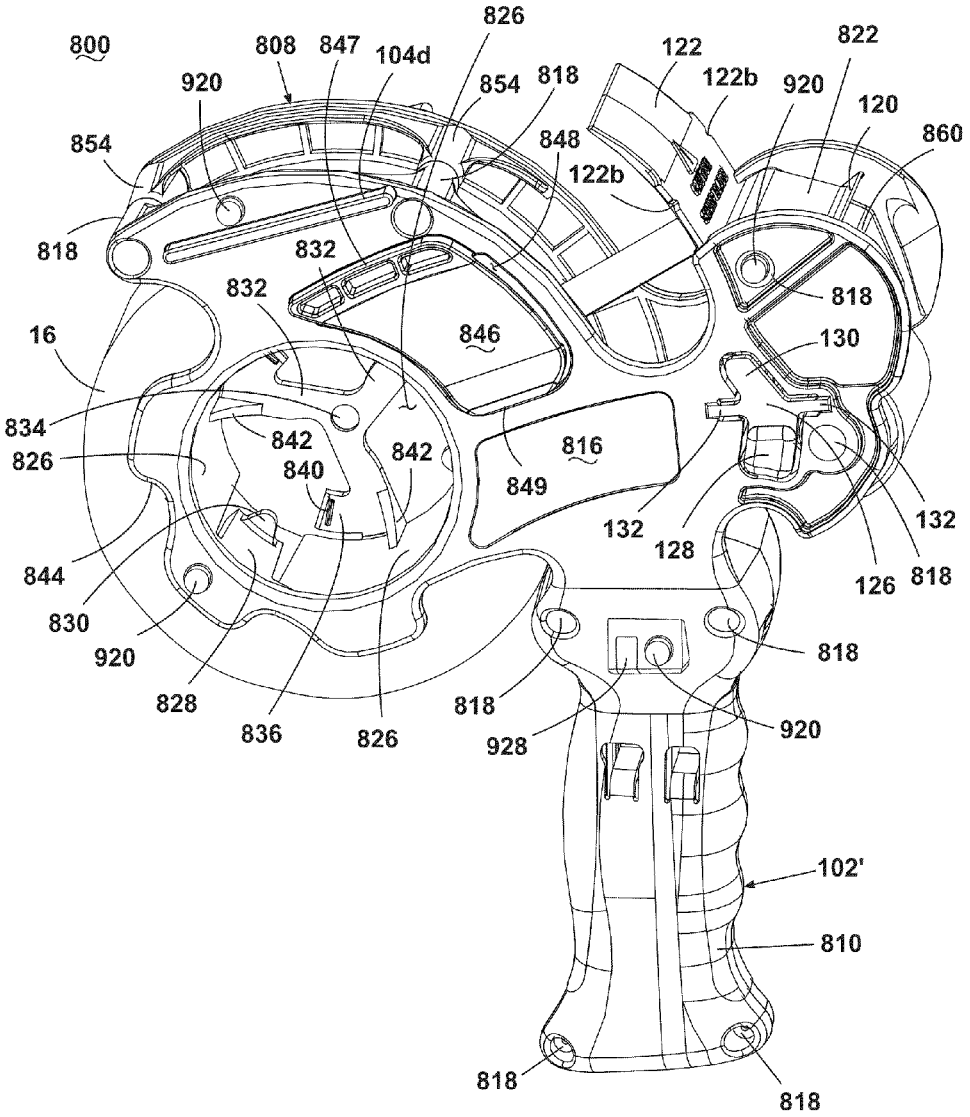
FIG. 15 is a left side view of the dispenser handle and spool assembly shown in FIG. 14.
Figure 16:
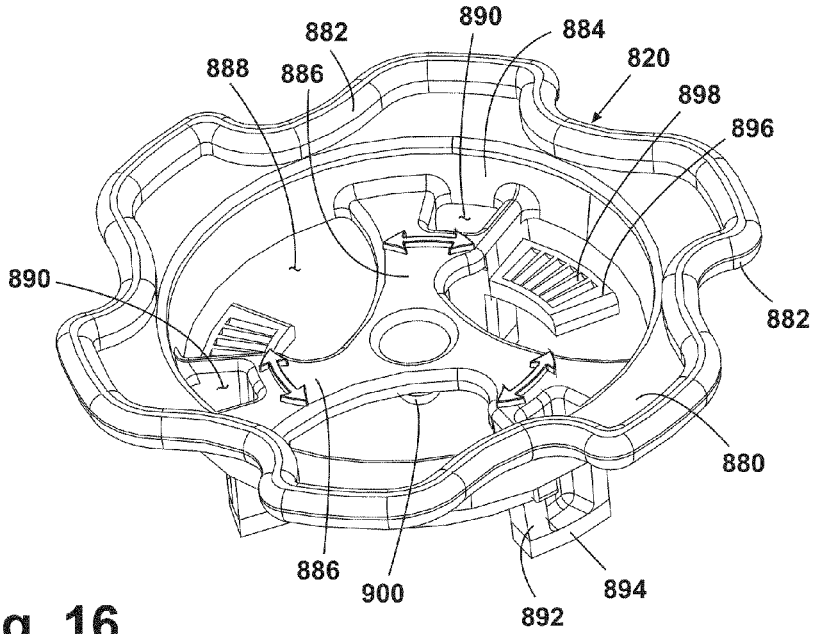
FIG. 16 is an outside perspective view of a hub illustrated in FIG. 14.
Figure 17:
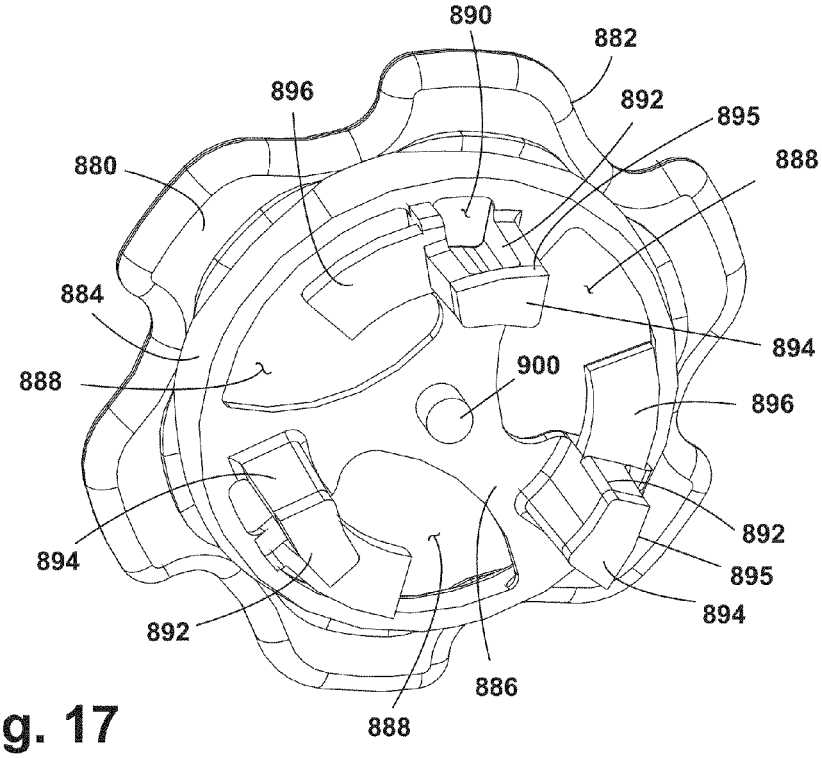
FIG. 17 is an inside perspective view of the hub illustrated in FIG. 16.

When the main frame half 806 and the cover frame half are joined together, the hollow projections 818 and the hollow post 854 meet. In a mechanical operation, heating elements extend into the interior of the hollow posts 854 and the hollow posts 818 to weld the two frame halves together to make a unitary frame as illustrated in FIG. 15. Prior to bringing the two frame halves together, a roller 112 is mounted on to a post 818 and a tape measure 404 is mounted within the tape cavity 814. Further, the transverse support 822 and the guide face 860 form therebetween the blade slot that receives and retains the blade 120. Elastomeric sheets 852 having frictional surfaces are molded to conform to the grip portions 810 and 850 to assist in gripping the tape dispenser.

The hub 820 is formed with a rim 880 having an undulating outer edge 882 and a depending cylindrical wall 884. Spokes 886 extend inwardly from the bottom of the cylindrical wall 884 to define spaced openings 888 therebetween. Each of the spokes 886 further forms an opening 890. U-shaped posts extend from the ribs 886 adjacent to the opening 890 and have a bottom wall 894 that has at an outer circumferential edge a cam follower surface 895. A cantilevered retaining flange 896 having positioning indentations 898 extends in a circumferential direction from one of the legs of each of the U-shaped legs 892. A central mounting shaft 900 extends from a central portion of the spokes 886.

Figure 18:
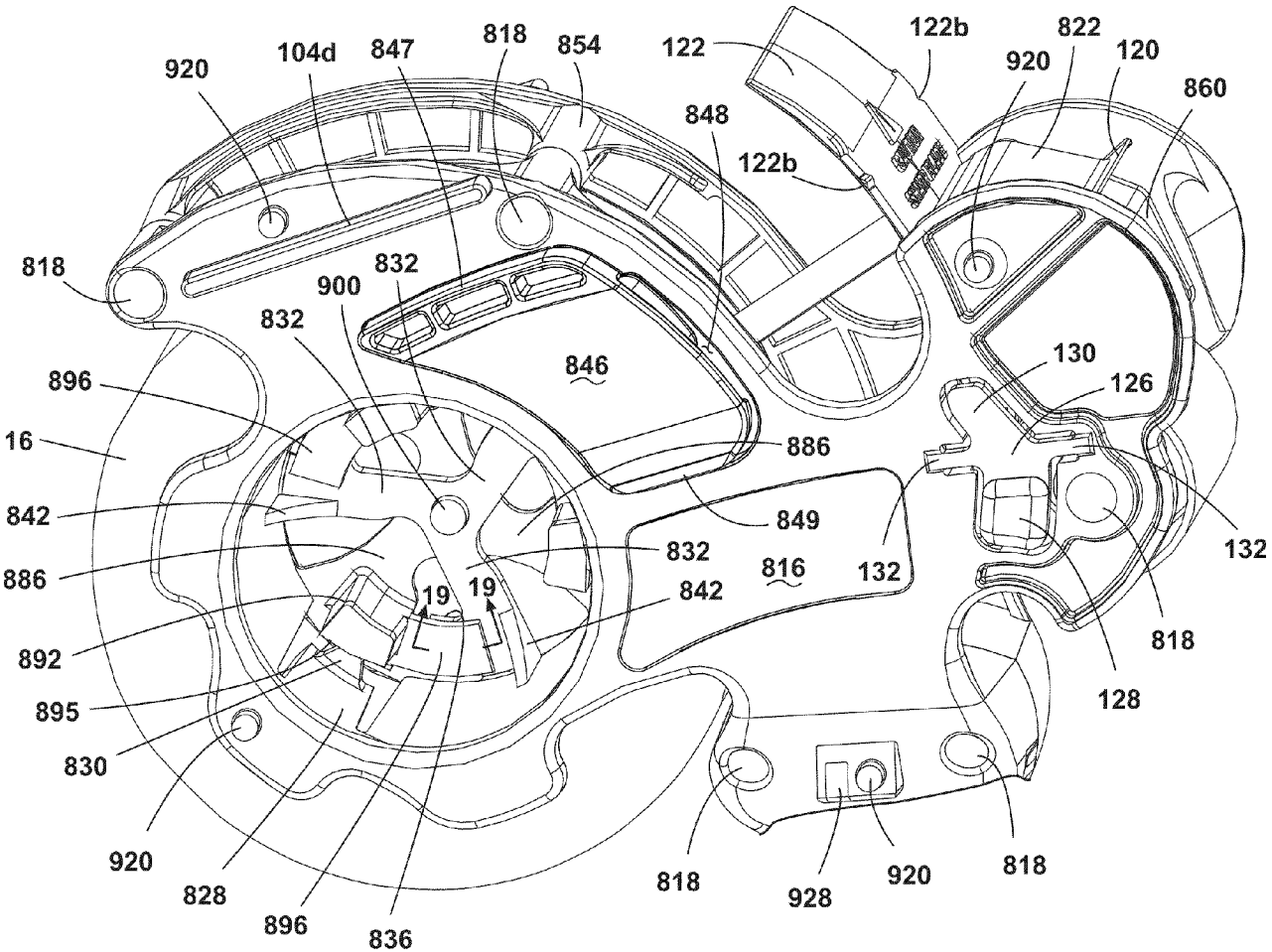
FIG. 18 is a partial view like FIG. 15 of a left side view of the handle spool assembly and hub.
Figure 19:
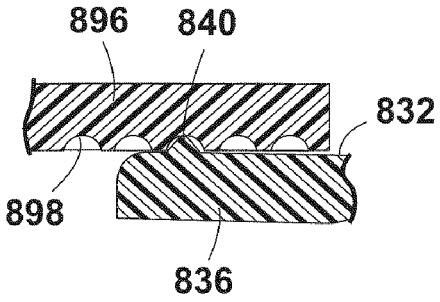
FIG. 19 is a sectional view taken along the lines 19-19 of FIG. 18.

When the hub 820 is mounted to the spool assembly 804, the central mounting shaft 900 is received within the opening 834 in the central portion of the spokes 832. As illustrated in FIG. 18, the U-shaped legs 892 project through the openings between the spokes 832 of the spool assembly. When the hub 820 is positioned fully within the spool assembly, it is rotated in a clockwise direction whereby the cantilevered retaining flanges 896 on the hub seat behind the retainer flanges 836 on the spool assembly as illustrated in FIGS. 18 and 19. The projections 840 are received in one of the positioning indentations 898 in the cantilevered retaining flanges 896. Rotation of the hub with respect to the spool assembly in a clockwise or counterclockwise position adjusts the relative position of the hub with respect to the spool assembly.

When the retaining flanges are seated behind one another as illustrated in FIGS. 18 and 19, the cam follower surface 895 of the bottom wall 894 of the hub abuts the cam 830 of the tensioning flange 828. The cam follower surface 895 is ramped in a clockwise direction as viewed in FIG. 18 so that rotation of the hub with respect to the spool assembly as viewed in FIG. 18 pushes the tensioning flange 828 radially outwardly to increase friction on the spool of the tape. Thus, rotation of the hub 820 with respect to the spool 824 in a clockwise or counterclockwise positioned incrementally adjusts frictional resistance between the spool of the tape and the spool 824 of the dispenser, thereby adjusting the tension on the tape as it is dispensed. This feature is important so that the user can adjust the tension in the tape to tailor the tension to the characteristics of the individual tape and the manner in which is used. Further, small incremental adjustment of the tension in the tape is facilitated by the incremental adjustment of the projections 840 of the retainer flanges 836 and by the positioning indentations of the cantilevered retaining flanges 896. This type of tensioning system may be used in other types of spool dispensers, for example, for dispensing of MIG and TIG welding material for use in welding operations.

Load cells 920 are positioned on the surface of the spool face portion 816 so that the tape dispenser can be stably positioned on a work surface. Any number of load cells 920 can be used on the spool face portion 816 but at least 3 such load cells are believed to be desirable so that the weight of each of the load cells can be measured.

Figure 20:
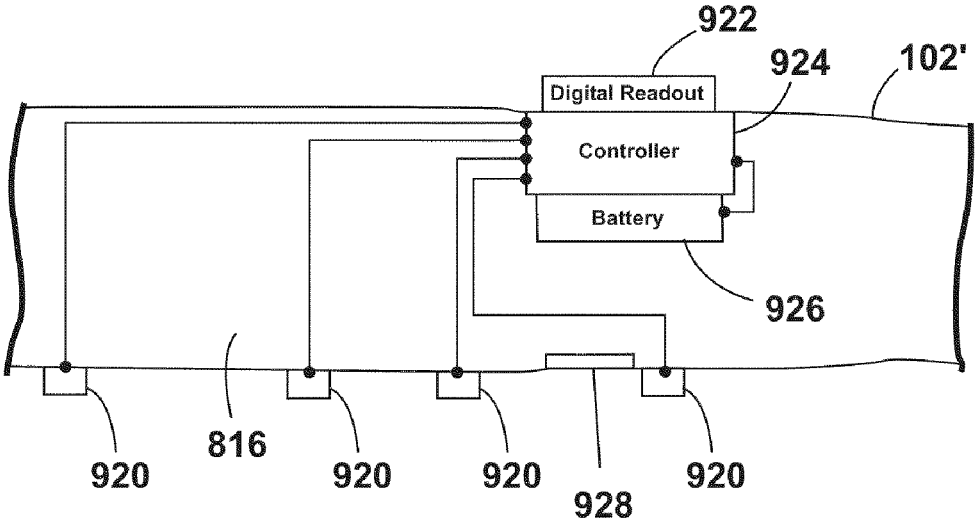
FIG. 20 is a schematic view of electrical system of a digital scale that is mounted into the dispenser according to the invention.

Referring now to FIG. 20, which is a schematic view of an electrical system for measuring the weight of packages for purposes of determining the appropriate postage or other cost for shipping a package, the load cells 920 are connected to a controller 924 which has a digital readout 922 in the cover plate half 856. The controller 922 has a battery 926 which is accessible through a battery door 928 in the spool face portion 816. Piezo electric elements in the load cells 920 transmit a signal to the controller representative of the force measured by each of the load cells 920. The controller then computes the weight of the package based on the input from the load cells 920. When the packages removed from the dispenser, the digital readout module 922 will indicate the weight of the package. With this configuration, loads up to 30-50 lbs. can be measured with the load measuring system integrated into the dispenser according to one embodiment of the invention.

The dispenser 100' can be removably mounted to the dispenser supporting bracket in any of the three configurations described above for storing the dispenser, either temporarily or more permanently, or for dispensing tape, all of which are described above with respect to FIG. 5-FIG. 5*d*.

It is understood that the disclosed embodiments are representative of presently preferred forms of the invention, but are intended to be illustrative rather than definitive of the invention. Reasonable variation and modification are possible within the scope of the foregoing disclosure and drawings without departing from the spirit of the invention which is set forth in the accompanying claims.

What is claimed is:

1. A tape dispenser of the type having a dispenser body with a spool for rotationally mounting a roll of tape on the dispenser body, and a cutting element separably fixed within the dispenser body and spaced from the spool for cutting a leading end of tape dispensed from the spool, a press plate having a planar pressing surface bounded by an end edge and side edges of the plate and extending transverse to the cutting element for applying tape to a working surface and a gripping handle for one-handed application and cutting of tape from a roll of tape rotationally mounted on the tape dispensing body;

wherein the press plate is mounted in the dispenser body for selective movement between a first position for applying the pressing surface of the press plate against a portion of the dispensed tape onto the working surface prior to cutting the tape and a second position wherein the press plate is positioned substantially within the tape dispensing body to permit tape to be dispensed directly from the roll across the cutting element without contacting the press plate;

wherein the press plate is selectively secured in the first position wherein the pressing surface of the press plate can firmly hold the leading end of a tape against a work surface; and is selectively retained in the second position for selective dispensing of discrete segments of tape from the roll without use of the press plate.

2. The tape dispenser of claim 1 wherein the press plate is curved and rides in a curved track in the tape dispensing body.

3. The tape dispensing body of claim 1 and further comprising a mounting bracket assembly, wherein the tape dispensing body further comprises a front end that includes the cutting element for cutting tape dispensed by the tape dispensing body, a rear end, and sidewalls, the sidewalls having exterior rails protruding therefrom;

the mounting bracket assembly has a pair of side walls rigidly joined together to form an open interior with an open front and open bottom, and at least one additional panel that is adapted to mount the bracket assembly to at least one of a post, an upright surface and the underside of a horizontal surface; and the interior portions of the bracket sidewalls have supports that are adapted to mate with the exterior rails on the tape dispensing body sidewalls to support the tape dispenser in a tape dispensing position wherein the rear end of the tape dispensing body is within the bracket and the front end of the body faces outwardly for one-handed dispensing of the tape.

4. The tape dispenser according to claim 3 wherein the mounting bracket has a pair of generally vertical rails extending outwardly from a rear potion thereof and further comprising a shipping station organizer having an upright back wall and a laterally extending base, and the upright back wall has a pair or rails that are spaced and configured to slidably receive the mounting bracket generally vertical rails to mount the mounting bracket to the upright back wall of the shipping station organizer.

5. The tape dispenser according to claim 3 wherein the supports are further configured to support the tape dispensing body in a position wherein the front end of the tape dispensing body is within the bracket and the rear end of the body faces outwardly for temporary storage of the tape dispenser.

6. The tape dispenser according to claim 3 wherein the interior portions of the bracket sidewalls further have locking slots for selective secured mounting of the tape dispensing body in the bracket body in the tape dispensing position.

7. The tape dispenser according to claim 6 wherein the bracket side wall locking slots include a cam to guide the exterior rails of the tape dispensing body into selective secured mounting.

8. The tape dispenser according to claim 1 wherein the press plate is selectively secured at least in part by integrally molded cantilevered locking fingers.

9. A tape dispenser of the type having a dispenser body with a spool for rotationally mounting a roll of tape on the dispenser body, and a cutting element spaced from the spool for cutting a leading end of tape dispensed from the spool, a press plate for applying tape to a working surface and a gripping handle for one-handed application and cutting of tape from a roll of tape rotationally mounted on the tape dispensing body;

wherein the press plate is mounted in the dispenser body for movement between a first position for holding tape against the working surface prior to cutting the tape and a second position wherein the press plate is retracted substantially within the tape dispensing body to permit tape to be dispensed directly from the roll across the cutting element without contacting the press plate; and wherein the press plate has indentations in the edges thereof and the tape dispensing body has side walls with detents that are releasably received in the press plate indentations to selectively retain the press plate in the first and second positions.

10. The tape dispenser according to claim 9 wherein the detents are formed by integrally molded cantilevered locking fingers.

* * * * *